US009921506B2

(12) United States Patent
Hirano et al.

(10) Patent No.: US 9,921,506 B2
(45) Date of Patent: Mar. 20, 2018

(54) ELECTROPHOTOGRAPHIC IMAGE FORMING METHOD AND FULL COLOR TONER SET FOR DEVELOPING ELECTROSTATIC IMAGE

(71) Applicant: Konica Minolta, Inc., Tokyo (JP)

(72) Inventors: Shiro Hirano, Hachioji (JP); Naoya Tonegawa, Sagamihara (JP); Masaharu Matsubara, Hachioji (JP); Kouji Sekiguchi, Tokyo (JP); Atsushi Iioka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/209,866

(22) Filed: Jul. 14, 2016

(65) Prior Publication Data

US 2017/0045835 A1 Feb. 16, 2017

(30) Foreign Application Priority Data

Aug. 12, 2015 (JP) ..... 2015-159323

(51) Int. Cl.
*G03G 9/087* (2006.01)
*G03G 9/09* (2006.01)
*G03G 15/01* (2006.01)

(52) U.S. Cl.
CPC ..... *G03G 9/092* (2013.01); *G03G 9/08711* (2013.01); *G03G 9/08755* (2013.01);
(Continued)

(58) Field of Classification Search
CPC ..... G03G 9/08711; G03G 9/08755
See application file for complete search history.

(56) References Cited

U.S. PATENT DOCUMENTS

2004/0185363 A1* 9/2004 Kidokoro ..... G03G 9/0821 430/108.21
2005/0277050 A1* 12/2005 Yamazaki ..... G03G 15/161 430/125.3

(Continued)

FOREIGN PATENT DOCUMENTS

JP 2007322477 A 12/2007
JP 2008090054 A 4/2008

(Continued)

OTHER PUBLICATIONS

Notification of Reasons of Rejection dated Sep. 6, 2016 from corresponding Japanese Application; Patent Application No. 2015-159323; English translation of Notification of Reasons of Rejection; Total of 7 pages.

*Primary Examiner* — Hoa V Le
(74) *Attorney, Agent, or Firm* — Lucas & Mecanti, LLP

(57) ABSTRACT

Provided is a method of forming an electrophotographic image using a plurality of color toners, the method containing: a charging step; an exposing step; a developing step; and a transferring step, wherein the plurality of color toners each respectively contain toner particles including a binder resin, a coloring agent, a releasing agent, and a crystalline resin; the binder resin contains an amorphous vinyl polymer formed with a vinyl monomer; the toner particles contain the amorphous vinyl polymer in the range of 10 to 90 mass %; and a maximum value of an acid value difference of the color toners is in the range of 1 to 10 mg KOH/g.

20 Claims, 1 Drawing Sheet

(52) U.S. Cl.
CPC ..... *G03G 9/08786* (2013.01); *G03G 9/08797* (2013.01); *G03G 9/091* (2013.01); *G03G 9/0904* (2013.01); *G03G 9/0918* (2013.01); *G03G 15/0121* (2013.01)

(56) References Cited

U.S. PATENT DOCUMENTS

| | | | | |
|---|---|---|---|---|
| 2011/0305984 | A1* | 12/2011 | Tominaga ..... | G03G 9/09314<br>430/108.4 |
| 2015/0153670 | A1* | 6/2015 | Shimano ..... | G03G 9/08755<br>430/109.3 |

FOREIGN PATENT DOCUMENTS

| | | | |
|---|---|---|---|
| JP | 2008216624 | A | 9/2008 |
| JP | 2014035506 | A | 2/2014 |
| JP | 2015106135 | A | 6/2015 |

* cited by examiner

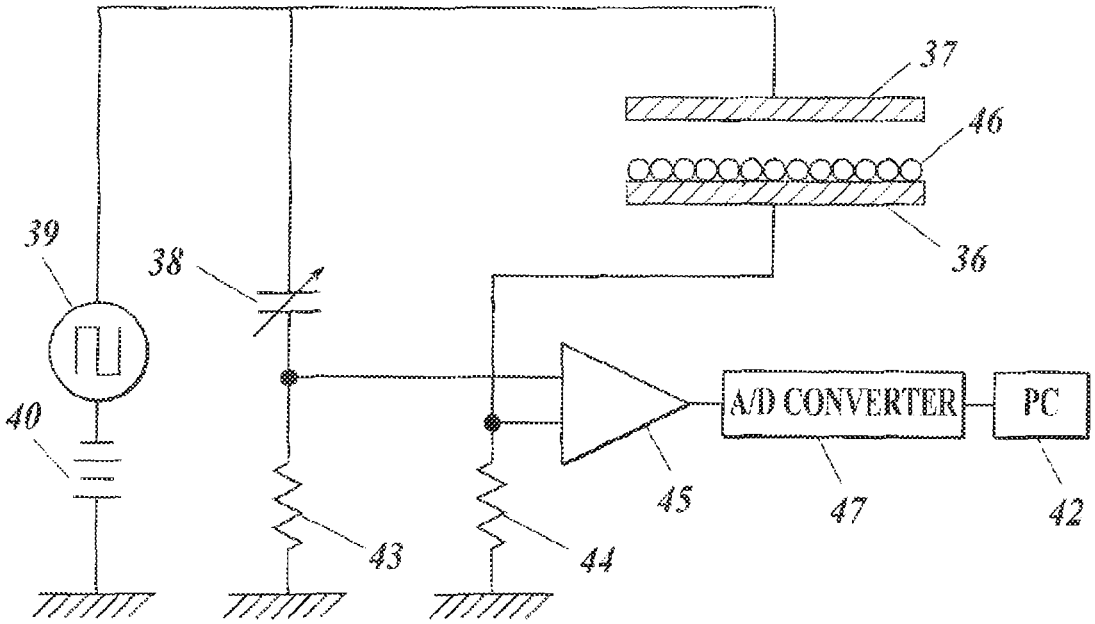
37
46
36
39
38
40
A/D CONVERTER
PC
45
47
42
43
44

ELECTROPHOTOGRAPHIC IMAGE FORMING METHOD AND FULL COLOR TONER SET FOR DEVELOPING ELECTROSTATIC IMAGE

This application is based on Japanese Patent Application No. 2015-159323 filed on Aug. 12, 2015 with Japan Patent Office, the entire content of which is hereby incorporated by reference.

TECHNICAL FIELD

The present invention relates to an electrostatic image forming method and a full color toner set for developing an electrostatic image. More specifically, the present invention relates to an electrophotographic image forming method and a full color toner set for developing an electrostatic image excellent in low-temperature fixability and thermal resistance, and also excellent in document offset property, color gamut, and environmental charge stability.

BACKGROUND

In recent years, a toner for developing an electrostatic image (hereafter, it is called simply as "a toner") of an image forming apparatus using an electrophotographic method is required to be thermally fixed at a lower temperature in order to achieve high print speed and further energy saving for the purpose of decrease of load to the environment. Such toner is required to have a binder resin of a low melting point or a low viscosity. It was proposed a toner enabling to improve low-temperature fixability by adding a crystalline resin such as a crystalline polyester resin as a plasticizer (fixing auxiliary agent).

For example, in Patent document 1 (JP-A No. 2008-090054), it was proposed a technology which makes possible to achieve excellent cleaning property, and a good balance between low-temperature fixability and thermal resistance by defining an acid value of each color toner containing a crystalline polyester resin in a color toner set having a plurality of colors.

Further, Patent document 2 (JP-A No. 2014-35506) disclosed a technology to achieve excellent charge stability, as well as a good balance between low-temperature fixability and thermal resistance by using a specific alkyl (meth) acrylate monomer in a toner containing a crystalline polyester compound and a styrene-acrylic resin.

However, it is important for a toner not only to achieve a good balance between low-temperature fixability and thermal resistance, but also to be provided with excellent document offset property (image storage property), color gamut (color reproducibility), and further, environmental charge stability that will not exhibit difference of charge depending on the environment. It is required a toner having all of these properties.

SUMMARY

The present invention was done based on the above-described problems and situations. An object of the present invention is to provide an electrophotographic image forming method and a full color toner set for developing an electrostatic image excellent in low-temperature fixability and thermal resistance, and also excellent in document offset property, color gamut, and environmental charge stability.

The present inventors have investigated the reasons of the above-described situation to solve the above-described object of the present invention. As a result, it was found to provide an electrophotographic image forming method excellent in low-temperature fixability and thermal resistance, and also excellent in document offset property, color gamut, and environmental charge stability by using the following specific toner. The toner contains a binder resin composed of an amorphous vinyl polymer formed with a vinyl monomer in a specific amount, and an acid value difference of each toner being defined in an appropriate value. Thus, the present invention has been achieved.

The above-described object of the present invention can be solved by the following embodiments.

1. A method of forming an electrophotographic image using a plurality of color toners, the method comprising: a charging step; an exposing step; a developing step; and a transferring step,
   - wherein the plurality of color toners each respectively contain toner particles including a binder resin, a coloring agent, a releasing agent, and a crystalline resin;
   - the binder resin comprises an amorphous vinyl polymer formed with a vinyl monomer;
   - the toner particles contain the amorphous vinyl polymer in the range of 10 to 90 mass %; and
   - a maximum value of an acid value difference of the color toners is in the range of 1 to 10 mg KOH/g.
2. The method of forming an electrophotographic image described in the embodiment 1,
   - wherein the amorphous vinyl polymer is a styrene-acrylic resin; and
   - the styrene-acrylic resin contains a structural unit derived from an alkyl (meth)acrylate monomer represented by Formula (1), $$H_2C{=}CR^1{-}COOR^2 \qquad \text{Formula (1):}$$

- wherein $R^1$ represents a hydrogen atom or a methyl group; and $R^2$ represents an alkyl group of 6 to 22 carbon atoms.
3. The method of forming an electrophotographic image described in the embodiment 2,
   - wherein $R^2$ in Formula (1) represents a branched alkyl group of 6 to 22 carbon atoms.
4. The method of forming an electrophotographic image described in any one of the embodiments 1 to 3,
   - wherein the toner particles in the plurality of color toners contain the amorphous vinyl polymer in the range of 50 to 80 mass %.
5. The method of forming an electrophotographic image described in any one of the embodiments 1 to 4,
   - wherein the crystalline resin is a crystalline polyester resin.
6. The method of forming an electrophotographic image described in the embodiment 5,
   - wherein the crystalline polyester resin is a hybrid resin having an amorphous resin segment bonded with a chemical bond.
7. The method of forming an electrophotographic image described in the embodiment 1,
   - wherein the plurality of color toners each are a yellow toner, a magenta toner, a cyan toner, and a black toner.
8. The method of forming an electrophotographic image described in the embodiment 1,
   - wherein the maximum value of an acid value difference of the color toners is in the range of 2 to 6 mg KOH/g.
9. The method of forming an electrophotographic image described in the embodiment 1,
   - wherein the crystalline resin contained in the toner particles is in the range of 1 to 30 mass %.

10. A full color toner set for developing an electrostatic image, the full color toner set comprising a plurality of color toners, wherein the plurality of color toners each respectively contain toner particles including a binder resin, a coloring agent, a releasing agent, and a crystalline resin;

the binder resin comprises an amorphous vinyl polymer formed with a vinyl monomer;

the toner particles contain the amorphous vinyl polymer in the range of 10 to 90 mass %; and a maximum value of an acid value difference of the color toners is in the range of 1 to 10 mg KOH/g.

By the above-described embodiments of the present invention, it can provide an electrophotographic image forming method and a full color toner set for developing an electrostatic image excellent in low-temperature fixability and thermal resistance, and also excellent in document offset property, color gamut, and environmental charge stability.

A formation mechanism or an action mechanism of the effects of the present invention is not clearly identified, but it is supposed as follows.

The present inventors supposed the following. By maintaining an acid value difference of color toners in an appropriate range, the mixing property of the resins in the color toners will be increased during the heat melting in the fixing step of the toner. Thereby intermolecular tangle of the resins in the color toners can be promoted, and it can be obtained excellent fixability, and also it can be improved secondary color reproducibility by superposing images.

When an acid value difference of color toners is too small, the mixing property of the resins become small. As a result, it is difficult to securely obtain an excellent fixability and excellent secondary color reproducibility. On the other hand, when an acid value difference of color toners is too large, the affinity of resins will be decreased due to the increase of the difference of polarity of the resins in the color toners. This will lead to decrease of mixing property of the resins.

When the binder resin does not contain an amorphous vinyl polymer, it will be produced a new problem that the difference in environmental charge stability between color toners becomes significant because the acid value difference of color toners is required to be 10 mg KOH/g or more.

On the other hand, when the binder resin contains an amorphous vinyl polymer, the mixing of the resins between the color toner layers can be achieved even by the resins having the acid value difference of color toners in the range of 1 to 10 mg KOH/g. As a result, the mixing property of the resins in the color toner layers will be exhibited and it can be obtained excellent fixability and excellent secondary color reproducibility without inducing the difference in environmental charge stability between color toners.

The reason of the above-described effect is as follows. It is supposed that the effect is caused by the different state of carboxy groups in the resin molecule chain. The carboxy group is an origin of the acid value.

In the amorphous vinyl polymer, the carboxy groups are uniformly located in the resin molecule chain. However, in the amorphous polyester resin (non-vinyl polymer), the carboxy groups are only located at an end portion of the resin molecule chain. An amount of carboxy group in the resin molecules will be unhomogeneous. Therefore, an acid value difference in a molecule level will be indefinite. As a result, when the required mixing property of the resins in the color toner layers is intended to achieved by using only the amorphous polyester resin, it is required to make the acid value difference of the resins in the color toner layers to be extremely large. Consequently, the acid value difference of the color toners will be larger than 10 mg KOH/g. This will produce a new problem that the difference in environmental charge stability between color toners becomes worsen. On the other hand, when the amorphous vinyl resin, which contains carboxy groups uniformly in the resin chain, is included in the binder resin, the acid value difference of the color toner layers will be definite even in the range of 1 to 10 mg KOH/g of the acid value difference. As a result, the resin mixing property can be effectively achieved.

Further, by using an acid monomer of 3 or more functional groups (such as trimellitic acid) for the amorphous polyester resin, it is possible to introduce carboxy groups in the resin molecular chain. However, it may induce a partial cross-linking reaction, and this will result in degradation of fixing property. Therefore, the balance with the fixing property will be difficult. Consequently, introduction of the amorphous vinyl resin in the binder resin is required.

Moreover, the present inventors found the following. By incorporating a crystalline resin (for example, a crystalline polyester resin), it can achieve a good balance between low-temperature fixability and thermal resistivity. In addition, at the same time, by incorporating an amorphous vinyl polymer having a low compatibility with the crystalline polyester than the amorphous polyester resin, it can be maintained the crystalline state of the crystalline polyester in the image after fixing without melting each other. Therefore, an excellent document offset property can be realized.

BRIEF DESCRIPTION OF THE DRAWING

FIG. 1 is a schematic drawing of an apparatus for measuring a charge amount of the toner used in the examples.

DESCRIPTION OF THE PREFERRED EMBODIMENTS

The method of forming an electrophotographic image of the present invention is characterized in having the following feature. The method uses a plurality of color toners, and the method contains: a charging step; an exposing step; a developing step; and a transferring step. Wherein the plurality of color toners each respectively contain toner particles including a binder resin, a coloring agent, a releasing agent, and a crystalline resin; the binder resin contains an amorphous vinyl polymer formed with a vinyl monomer; the toner particles contain the amorphous vinyl polymer in the range of 10 to 90 mass %; and a maximum value of an acid value difference of the color toners is in the range of 1 to 10 mg KOH/g. The above-described technical feature is common to the embodiments 1 to 10 of the present invention.

One of the preferable embodiments of the present invention is characterized in that: the amorphous vinyl polymer is a styrene-acrylic resin; and the styrene-acrylic resin contains a structural unit derived from an alkyl (meth)acrylate monomer represented by the above-described Formula (1). By satisfying this condition, it becomes possible to encapsulate or to control the dispersion of the crystalline polyester in the toner. Thus, it is possible to obtain further excellent low-temperature fixability and thermal resistivity.

A further preferable embodiment is that $R^2$ in Formula (1) represents a branched alkyl group of 6 to 22 carbon atoms from the viewpoint of obtaining further excellent low-temperature fixability and thermal resistivity, and document offset property.

Another preferable embodiment of the present invention is characterized in that the toner particles in the plurality of color toners contain the amorphous vinyl polymer in the range of 50 to 80 mass % from the viewpoint of improving low-temperature fixability and thermal resistivity, and document offset property.

Another preferable embodiment of the present invention is characterized in that the crystalline resin is a crystalline polyester resin from the viewpoint of improving low-temperature fixability.

Another preferable embodiment of the present invention is characterized in that the crystalline polyester resin is a hybrid resin having an amorphous resin segment bonded with a chemical bond from the viewpoint of improving low-temperature fixability.

The plurality of color toners according to the present invention as described above may suitably adopt the full color toner set for developing an electrophotographic image.

The present invention and the constitution elements thereof, as well as configurations and embodiments, will be detailed in the following. In the present description, when two figures are used to indicate a range of value before and after "to", these figures themselves are included in the range as a lowest limit value and an upper limit value.

<<Summary of Electrophotographic Image Forming Method>>

The method of forming an electrophotographic image of the present invention is characterized in having the following feature. The method uses a plurality of color toners, and it contains: a charging step; an exposing step; a developing step; and an transferring step. Wherein the plurality of color toners each respectively contain toner particles including a binder resin, a coloring agent, a releasing agent, and a crystalline resin; the binder resin contains an amorphous vinyl polymer formed with a vinyl monomer; the toner particles contain the amorphous vinyl polymer in the range of 10 to 90 mass %; and a maximum value of an acid value difference of the color toners is in the range of 1 to 10 mg KOH/g.

The control of the acid value can be made by adjustment of an amount of carboxy groups.

For example, when the toner particles contain a styrene-acrylic resin (amorphous vinyl polymer), the control of the acid value is done by adjusting the amount of added methacrylic acid used for a carboxy group in the side chain of the molecule. When a polyester resin is included, the amount of carboxy group at the end of the molecular chain can be adjusted by the ratio of added acid or alcohol, or by the molecular weight thereof. However, it is preferable to adjust by the ratio of added acid or alcohol, because it can avoid the change of thermal property such as fixability.

[Plurality of Color Toners]

The plurality of color toners of the present invention are not limited in particular as long as they are a plurality of color toners each respectively composed of toner particles having a different color. Preferably, they are 4 color toners of a yellow toner, a magenta toner, a cyan toner, and a black toner.

A maximum value of an acid value difference of the color toners of the present invention is in the range of 1 to 10 mg KOH/g. Preferably, an acid value difference is in the range of 2 to 6 mg KOH/g in order to suitably obtain the effect of the present invention.

<Acid Value>

An acid value is an amount of potassium hydroxide in mg (mg KOH/g) required to neutralize a carboxy group existing in 1 g of sample. The acid value is measured with a method defined in JIS K0070-1992. Specific operation is described in the examples of the present invention.

The above-describe "maximum value of an acid value difference of the color toners" indicates a maximum value among acid value differences of the color toners.

[Toner Particle]

Here, "toner particles" according to the present invention are particles including a binder resin, a coloring agent, a releasing agent, and a crystalline resin. Although it is preferable that the toner particles are usually used by adding an external additive, the external additive may not be added.

The toner particles contained in the plurality of color toners include an amorphous vinyl polymer (describe later) in the range of 10 to 90 mass %. Preferably, the toner particles include an amorphous vinyl polymer in the range of 50 to 80 mass % for improving a document offset property.

<Binder Resin>

The binder resin according to the present invention contains at least an amorphous vinyl polymer formed by using a vinyl monomer.

(Amorphous Vinyl Polymer)

As an amorphous vinyl polymer, it can be specifically cited an acrylic resin, and a styrene-acrylic co-polymer resin.

As vinyl monomers to form an amorphous vinyl polymer, the following may be used. The vinyl monomers may be used alone, or may be used in combination of two or more kinds.

(1) Styrene monomers: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers.

(2) (Meth)acrylic acid ester monomers: methyl (meth)acrylate, ethyl (meth)acrylate, n-butyl (meth)acrylate, iso-propyl (meth)acrylate, iso-butyl (meth)acrylate, t-butyl (meth)acrylate, n-octyl (meth)acrylate, 2-ethylhexyl (meth)acrylate, stearyl (meth)acrylate, lauryl(meth)acrylate, phenyl (meth) acrylate, diethylaminoethyl (meth)acrylate and dimethylaminoethyl (meth)acrylate, and derivatives of these monomers.

(3) Vinyl esters: vinyl propionate, vinyl acetate, and vinyl benzoate.

(4) Vinyl ethers: vinyl methyl ether and vinyl ethyl ether.

(5) Vinyl ketones: vinyl methyl ketone, vinyl ethyl ketone and vinyl hexyl ketone.

(6) N-vinyl compounds: N-vinyl carbazole, N-vinyl indole, and N-vinyl pyrrolidone.

(7) Others: vinyl compounds such as vinylnaphthalene and vinylpyridine; acrylic acid or methacrylic acid derivatives such as acrylonitrile, methacrylonitrile, and acrylamide.

It is preferable to use vinyl monomers containing ionic-dissociative group such as a carboxy group, a sulfonic acid group or a phosphoric acid group. Specific examples are as follows.

Examples of a monomer containing a carboxy group are: acrylic acid, methacrylic acid, maleic acid, itaconic acid, cinnamic acid, fumaric acid, monoalkyl maleate, and monoalkyl itaconate.

Examples of a monomer containing a sulfonic acid group are: styrenesulfonic acid, alkylsulfosuccinic acid, and 2-acrylamido-2-methylpropanesulfonic acid.

An example of a monomer containing a phosphoric acid group is acid phosphooxyethyl methacrylate.

In the present invention, it is preferable to use a monomer containing a carboxy group as a vinyl monomer. A content of a monomer containing a carboxy group in the total vinyl monomers is preferably in the range of 2 to 7 mass %. When the content of a monomer containing a carboxy group is within this range, an amount of water adsorbed to the surface of toner particles will not be increased, and it can control generation of toner blister or increase of environmental difference of charge amount.

Further, the amorphous vinyl polymer may be changed into a cross-linked resin by using poly-functional vinyl compounds as vinyl monomers. Examples of a poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

A preferable amorphous vinyl polymer is a styrene-acrylic resin formed with a styrene monomer and an alkyl (meth) acrylate monomer.

Examples of an alkyl (meth)acrylate monomer are as follows. As a monomer having a straight-chain alkyl group, it can be cited: n-butyl acrylate (having a straight-chain alkyl group of 4 carbon atoms) and n-octyl acrylate (having a straight-chain alkyl group of 8 carbon atoms). As a monomer having a branched alkyl group, it can be cited: 2-ethylhexyl acrylate (having a branched-chain alkyl group of 8 carbon atoms), isostearyl acrylate (having a branched alkyl group of 18 carbon atoms), behenyl acrylate (having a branched alkyl group of 22 carbon atoms), cellothyl acrylate (having a branched alkyl group of 26 carbon atoms), 2-ethylhexyl methacrylate, 1-methylheptyl acrylate, 2-propylheptyl acrylate, 6-methylheptyl acrylate, isooctyl acrylate, isononyl acrylate, isodecyl acrylate, tridecyl acrylate, and tridecyl methacrylate.

A preferable alkyl (meth)acrylate monomer contains a structure unit represented by Formula (1) from the viewpoint of obtaining excellent low-temperature fixability and thermal resistivity. When an alkyl (meth)acrylate monomer having a long chain alkyl group (in the range of 6 to 22 carbon atoms) is incorporated in the amorphous vinyl polymer, it becomes possible to encapsulate or to control the dispersion of the crystalline polyester in the toner. Thus, it is supposed that it can obtain further excellent low-temperature fixability and thermal resistivity.

$$H_2C{=}CR^1{-}COOR^2 \qquad \text{Formula (1)}$$

In Formula (1), $R^1$ represents a hydrogen atom or a methyl group; and $R^2$ represents an alkyl group of 6 to 22 carbon atoms.

When $R^2$ in Formula (1) represents an alkyl group in the range of 6 to 22 carbon atoms, an excellent low-temperature fixability and thermal resistivity can be achieved. This is a preferable embodiment.

<Coloring Agent>

Orange coloring agents which may be used for an orange toner are: C. I. Solvent Oranges 63, 68, 71, 72, and 78; and C. I. Pigment Oranges 16, 36, 43, 51, 55, 59, 61, and 71.

Yellow coloring agents which may be used for a yellow toner are: C. I. Solvent Yellows 19, 44, 77, 79, 81, 82, 93, 98, 103, 104, 112, and 162; and C. I. Pigment Yellows 14, 17, 74, 93, 94, 138, 155, 180, and 185. The mixtures of these may be also used.

Magenta coloring agents which may be used for a magenta toner are: C. I. Solvent Reds 1, 49, 52, 58, 63, 111, and 122; and C. I. Pigment Reds 5, 48:1, 53:1, 57:1, 122, 139, 144, 149, 166, 177, 178, and 222. The mixtures of these may be also used.

Cyan coloring agents which may be used for a cyan toner are: C. I. Solvent Blues 25, 36, 60, 70, 93, and 95; C. I. Pigment Blues 1, 7, 15:3, 18:3, 60, 62, 66, and 76.

Green coloring agents which may be used for a green toner are: C. I. Solvent Greens 3, 5, and 28; and C. I. Pigment Green 7.

Black coloring agents which may be used for a black toner are: a carbon black, a magnetic material, and iron-titanium oxide black. Usable examples of a carbon black are: channel black, furnace black, acetylene black, thermal black, and lamp black. Usable examples of a magnetic material are: magnetite and ferrite.

The content of the coloring agent in the toner particles is preferably in the range of 0.5 to 20 mass parts, more preferably in the range of 2 to 10 mass parts with respect to the total mass of the toner particles.

<Releasing Agent>

Examples of a releasing agent are: polyethylene wax, paraffin wax, microcrystalline wax, Fischer-Tropsch wax, dialkyl ketone wax such as distearyl ketone, carnauba wax, montan wax, behenyl behenate, trimethylolpropane tribehenate, pentaerythritol tetramyristate, pentaerythritol tetrastearate, pentaerythritol tetra behenate, pentaerythritol diacetate dibehenate, glycerin tribehenate, 1,18-octadecanediol distearate, tristearyl trimellitate, ester wax such as distearyl maleate, ethylenediamine behenyl amide, and amide-based wax such as tristearyl amide of trimellitic acid.

It is preferable that a content of the releasing agent in the toner particles is in the range of 2 to 30 mass %, more preferably, it is in the range of 5 to 20 mass % with respect to the total mass of the toner.

<Crystalline Resin>

In the present invention, a crystalline resin is a resin exhibiting a clear endothermic peak measured with differential scanning calorimetry (DSC), instead of a stepwise change of heat absorption. Here, "a clear endothermic peak" designates a peak having a half bandwidth within 15° C. in an endothermic curve obtained by measurement with differential scanning calorimetry (DSC) under the condition of a temperature raising rate of 10° C./min.

In addition, the crystalline resin is preferably contained in the range of 1 to 30 mass % in the toner particles. When the content of the crystalline resin in the toner particles is 1 mass % or more, an effect can be efficiently obtained. Further, when the content of the crystalline resin in the toner particles is 30 mass % or less, blocking of the toner can be avoided.

Although the kind of the crystalline resin is not limited in particular, it is preferable to be a crystalline polyester resin in order to achieve low-temperature fixability. A crystalline polyester resin will easily absorb water due to the presence of an ester bond in the resin. By this, release of charge will be promoted and it can control the sticking of sheets of paper having a thermally fixed image thereon. This is a preferable embodiment.

(Crystalline Polyester Resin)

The crystalline polyester resin according to the present invention can be obtained by a polycondensation reaction between a two or more valent alcohol (a polyhydric alcohol component) and a two or more valent carboxylic acid (a polycarboxylic acid component).

In the present invention, "a crystalline polyester resin" indicates a resin which exhibits a clear endothermic peak among the above-described crystalline polyester resin.

The content of the crystalline polyester resin contained in the toner of the present invention is preferably 2 to 20 mass %, and more preferably 5 to 15 mass % of the binder resin.

A polycarboxylic acid is a compound containing two or more carboxy group in one molecule. Specific examples of thereof are: saturated aliphatic dicarboxylic acids such as oxalic acid, succinic acid, adipic acid, sebacic acid, azelaic acid, and n-dodecyl succinic acid; an alicyclic dicarboxylic acid such as cyclohexane dicarboxylic acid; an aromatic dicarboxylic acid such as terephthalic acid; polycarboxylic acids of 3 valent or more such as trimellitic acid, and pyromellitic acid; and acid anhydrides and alkyl esters of 1 to 3 carbon atoms of these compounds.

These compounds may be used alone, or may be used in combination of two or more kinds.

The polyhydric alcohol is a compound having two or more hydroxyl groups in the molecule.

Specific examples thereof include: aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; tri- or more hydric alcohols such as glycerin, pentaerythritol, trimethylol propane and sorbitol. These compounds may be used alone, or may be used in combination of two or more kinds.

From the viewpoint of obtaining sufficient low-temperature fixability, the melting point of the crystalline polyester resin is preferably from 60 to 90° C., more preferably from 70 to 85° C.

The melting point of the crystalline polyester resin can be adjusted by changing the resin composition.

The melting point of the crystalline polyester resin indicates the peak top temperature in the endothermic peaks, and it is a value measured with a differential scanning calorimeter "Diamond DSC" (PerkinElmer Inc.), for example.

Specifically, 1.0 mg of measuring sample (crystalline polyester resin) is enclosed in an aluminum pan (KIT NO. B0143013), and it is set to a sample holder of Diamond DSC. The measuring is done in the temperature range of 0 to 200° C., with temperature increasing rate of 10° C./min, and temperature decreasing rate of 10° C./min. The temperature control of heating-cooling-heating are conducted. And the data obtained in the second heating is analyzed.

The number average molecular weight (Mn) of the crystalline polyester resin is preferably from 1,000 to 15,000 from the viewpoint of low-temperature fixability and glossiness stability. The number average molecular weight (Mn) is a value measured with gel permeation chromatography (GPC) as follows.

Specifically, a device "HLC-8120 GPC" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 ml/min as a carrier solvent. The measuring sample (resin) is dissolved in tetrahydrofuran to a concentration of 1 mg/mL by a treatment with an ultrasonic disperser at room temperature for 5 minutes. The solution is then treated with a membrane filter having a pore size of 0.2 μm to obtain a sample solution. An aliquot (10 μl) of the sample solution is injected into the device along with the carrier solvent and is detected by means of a refractive index (RI) detector. The molecular weight distribution of the sample is calculated by using a calibration curve, which is determined by using standard monodisperse polystyrene particles. 10 kinds of polystyrene particles were used for making a calibration curve.

(Hybrid Resin)

Although the crystalline polyester resin may be composed of 100 mass % of the crystalline polyester resin segment, the crystalline polyester resin may be a hybrid resin having an amorphous resin segment bonded with a chemical bond. Namely, the crystalline polyester resin may be a vinyl modified crystalline polyester resin (a hybrid resin) in which a vinyl resin segment and a crystalline polyester resin segment are bonded. Preferably, the vinyl resin segment is a styrene-acrylic resin segment, and the content thereof is 5 to 30 mass % in the hybrid resin. A particularly preferable content thereof is 5 to 20 mass %.

Here, a hybrid resin (a hybrid crystalline polyester resin) designates a resin composed of a crystalline polyester resin segment and an amorphous resin segment, both being chemically bonded with each other. By using the hybrid resin as a plasticizer, it can improve the affinity of the plasticizer to the binder resin. The dispersion particle size of the plasticizer domain can be controlled to be uniform and minute. As a result, it can be obtained an effect of improvement in low-temperature fixability.

The crystalline polyester resin segment indicates a molecular chain that constitutes the crystalline polyester resin. The amorphous resin segment indicates a molecular chain that constitutes the amorphous resin that does not form a crystalline structure.

A weight average molecular weight (Mw) of the hybrid resin of the present invention is preferably in the range of 5,000 to 100,000, more preferably in the range of 7,000 to 50,000, and still more preferably in the range of 8,000 to 40,000 from the viewpoint of securely obtaining a good balance of sufficient low-temperature fixability and highly prolonged storage stability.

By making the weight average molecular weight (Mw) of the hybrid resin to be 100,000 or less, sufficient low-temperature fixability may be obtained. On the other hand, by making the weight average molecular weight (Mw) of the hybrid resin to be 5,000 or more, exceeded mutual dissolving of the hybrid resin and the amorphous resin can be controlled, and an image failure caused by coalition of toners may be effectively prevented.

(Crystalline Polyester Resin Segment in Hybrid Resin)

The crystalline polyester resin segment of the present invention indicates a portion derived from a known polyester resin formed by a polycondensation reaction of a carboxylic acid of a divalent or more (polycarboxylic acid) with an alcohol of a divalent or more (polyhydric alcohol). It is a resin segment having a clear endothermic peak as described above instead of stepwise change of heat absorption in the measurement of differential scanning calorimetry of toner.

The crystalline polyester resin segment according to the present invention is not limited in particular as long as it has a structural feature as described above.

For example, the following correspond to a hybrid resin having a crystalline polyester resin segment as long as a toner containing the following resin has a clear endothermic peak as described above. They are: a resin having a main chain of a crystalline polyester resin segment copolymerized with other component; and a resin having a main chain of other component copolymerized with a crystalline polyester resin segment.

As a valence number of polycarboxylic acid and polyhydric acid, preferably it is 2 or 3 respectively. A particularly preferable valence number is 2. Therefore, it will be described the most preferable embodiment having a valence number 2 (namely, about a dicarboxylic acid component and a diol component).

A preferable dicarboxylic acid component is an aliphatic dicarboxylic acid. It may be jointly used an aromatic dicarboxylic acid. A preferable aliphatic dicarboxylic acid is a straight alkyl type. By using the straight alkyl type, it will be produced an advantage of improving a crystalline property. The dicarboxylic acid component is not limited to use one kind, it may be used two or more kinds Examples of an aliphatic dicarboxylic acid include: oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid (dodecanedioic dicarboxylic acid), 1,13-tridecane dicarboxylic acid, 1,14-tetradecane dicarboxylic acid, 1,16-hexadecane dicarboxylic acid, and 1,18-octadecane dicarboxylic carboxylic acid. It can be used a low alkyl ester or an acid anhydride of these compounds.

Among the above-described aliphatic dicarboxylic acids, preferable are aliphatic dicarboxylic acids having 6 to 12 carbon atoms. Examples of an aromatic dicarboxylic acid which may be used with the aliphatic dicarboxylic acid are: terephthalic acid, isophthalic acid, orthophthalic acid, t-butyl isophthalic acid, 2,6-naphthalene dicarboxylic acid, and 4,4'-biphenyl dicarboxylic acid. Among these, from the viewpoint of easy availability and easy emulsification, it is preferable to use: terephthalic acid, isophthalic acid and t-butyl isophthalic acid.

As a dicarboxylic acid component for forming a crystalline polyester resin segment, it is preferable that the content of the aliphatic dicarboxylic acid is 50 mole % or more, more preferably 70 mole % or more, still more preferably 80 mole % or more, and most preferably 100 mole %. By making the content of the aliphatic dicarboxylic acid in the dicarboxylic acid component to be 50 mole % or more, it can be securely obtained a sufficient crystalline property of the crystalline polyester resin segment.

As a diol component, it is preferable to use an aliphatic diol. It may be included a diol other than an aliphatic diol when needed. As an aliphatic diol, it is preferable to use a straight chain type. By using a straight chain type, it will have an advantage of improving crystalline property. The diol component may be used alone, or may be used in combination of two or more kinds.

Examples of an aliphatic diol are: ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosandiol.

Among aliphatic diols, preferable diol components are aliphatic diols of 2 to 12 carbon atoms. More preferable diols are aliphatic diols of 6 to 12 carbon atoms.

Diols other than aliphatic diols, which may be co-used according to necessity, are: diols having a double bond; and diols having a sulfonic acid group. Specific diols having a double bond are: 2-butene-1,4-diol, 3-butene-1,6-diol, and 4-butene-1,8-diol.

As a diol component for forming a crystalline polyester resin segment, it is preferable that the content of the aliphatic diol is 50 mole % or more, more preferably 70 mole % or more, still more preferably 80 mole % or more, and most preferably 100 mole %. By making the content of the aliphatic diol in the diol component to be 50 mole % or more, it can be securely obtained a sufficient crystalline property of the crystalline polyester resin segment. At the same time, the produced toner will have excellent low-temperature fixability and the obtained final image will be provided with high glossiness.

Regarding the ratio of the diol component and the polycarboxylic acid component, it is preferred that the equivalent ratio of the hydroxy groups (OH) of the diol component to the carboxy groups (COOH) of the polycarboxylic acid component ([OH]/[COOH]) is in the range of 1.5/1 to 1/1.5, more preferably in the range of 1.2/1 to 1/1.2.

The preparation method of the crystalline polyester resin segment is not limited in particular. It may be produced by polycondensation (esterification) of the above-described polycarboxylic acid and polyhydric alcohol with a known esterification catalyst.

Usable catalysts for producing a crystalline polyester resin segment of the present invention are: alkali metal compounds made of sodium and lithium; alkali earth metal compounds made of magnesium and calcium; metal compounds made of metals such as aluminum, zinc, manganese, antimony, titanium, tin, zirconium, and germanium; phosphorous acid compounds, phosphoric acid compounds, and amine compounds.

Specific examples of a tin compound are: dibutyltin oxide, tin octylate, tin dioctylate, and salts thereof.

Specific examples of a titanium compound are: titanium alkoxides such as tetra-n-butyl titanate, tetraisopropyl titanate, tetramethyl titanate, and tetrastearyl titanate; titanium acylates such as polyhydroxy titanium stearate; and titanium chelates such as titanium tetraacetylacetonate, titanium lactate, and titanium triethanolaminate.

A specific example of a germanium compound is germanium dioxide.

Specific examples of an aluminum compound are: and oxide such as poly aluminum hydroxide, aluminum alkoxide, and tributyl aluminate.

These compounds may be used alone or in combination of two or more kinds.

The polymerization temperature is not limited in particular. A preferable polymerization temperature is in the range of 150 to 250° C. The polymerization time is not limited in particular. A preferable polymerization time is in the range of 0.5 to 10 hours. The inside pressure of the reaction system may be reduced when needed.

The content of each component segment in the hybrid resin may be determined with an NMR measurement or a measurement of Py-GC/MS of a methylation reaction, for example.

Here, the hybrid resin of the present invention contains the above-described crystalline polyester resin segment and an amorphous resin segment described in detail later. Although the hybrid resin of the present invention may be any form of a block copolymer or a graft copolymer as long as it contains both of a crystalline polyester resin segment and an amorphous resin segment, preferable is a graft copolymer. When the hybrid resin is a graft copolymer, it is easy to control the orientation of the crystalline polyester resin segment. Consequently, it is possible to give a sufficient crystalline property to the hybrid resin.

It is preferable that a crystalline polyester resin segment is grafted to a main chain of an amorphous resin segment. Namely, it is preferable that the hybrid crystalline polyester resin is a graft copolymer containing an amorphous resin segment as a main chain and a crystalline polyester resin segment as a side chain.

By making the above-described form, it can increase the orientation of the crystalline polyester resin segment. As a result, it is possible to improve the crystalline property of the hybrid resin.

In addition, the hybrid resin may further include a substituent such as a sulfonic acid group, a carboxy group or a urethane group. The inclusion of the above-described group may be in the crystalline polyester resin segment or in the amorphous resin segment which will be described later.

(Amorphous Resin Segment in Hybrid Resin)

The amorphous resin segment in the hybrid resin of the present invention is a portion derived from the amorphous resin other than the above-described crystalline polyester resin. The amorphous resin segment has a function to increase affinity of the hybrid resin with the amorphous resin which constitutes the binder resin. By the presence of the amorphous resin segment, the affinity of the hybrid resin with the amorphous resin will be improved. As a result, the hybrid resin will be easily incorporated in the amorphous resin, and electric-charging uniformity will be improved.

The incorporation of the amorphous resin segment into the hybrid resin (and in the toner) can be confirmed by determining a chemical structure with an NMR measurement or a measurement of Py-GC/MS of a methylation reaction, for example.

The amorphous resin segment is a resin segment that does not exhibit a melting point when a DSC measurement is done to the resin having the same chemical structure and molecular weight as the above-described amorphous resin segment. The amorphous resin segment has relatively high glass transition temperature (Tg). Here, it is preferable that the resin having the same chemical structure and molecular weight as the above-described amorphous resin segment has Tg1 (measured with DSC at a first temperature increasing step) in the range of 30 to 80° C., and more preferably in the range of 40 to 65° C.

The amorphous resin segment of the present invention is not limited in particular as long as it has the above-described structure. For example, a resin having a structure containing a main chain of an amorphous resin segment copolymerized with other component, or a resin having a structure containing a main chain of other component copolymerized with an amorphous resin segment is within the hybrid crystalline polyester resin of the preset invention as long as the toner contains a resin having an amorphous resin segment as described above.

It is preferable that the amorphous resin segment of the present invention is composed of the same kind of resin as the amorphous resin included in the binder resin (that is, a resin other than the hybrid resin). By making this embodiment, the affinity of the hybrid resin with the amorphous resin will be improved. As a result, the hybrid resin will be more easily incorporated in the amorphous resin, and electric-charging uniformity will be further improved.

Here, "the same kind of resin" indicates the resin in which a characteristic chemical bond is commonly included in the repeating unit. The meaning of "the characteristic chemical bond" is determined by "polymer classification" indicated in a database provided by National Institute for Material Science (NIMS): (http://polymer.nims.go.jp/PoLyInfo/guide/jp/term_polymer.html). Namely, the chemical bonds which constitute the following 22 kinds of polymers are called as "the characteristic chemical bonds": polyacryls, polyamides, polyacid anhydrides, polycarbonates, polydienes, polyesters, poly-halo-olefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

"The same kind of resins" for the copolymer resins indicates resins having a common characteristic chemical bond in the chemical structure of a plurality of monomers which constitute the copolymer, when the copolymer has the monomers including the above-described chemical bonds as constituting units. Consequently, even if the resins each have a different property with each other, and even if the resins each have a different molar ratio of the monomers which constitute the copolymers, the resins are considered to be the same kind of resins as long as they contain a common characteristic chemical bond.

For example, the resin (or the resin segment) formed with styrene, butyl acrylate and acrylic acid and the resin (or the resin segment) formed with styrene, butyl acrylate and methacrylic acid both have at least a chemical bond constituting polyacrylate. Therefore, these two resins are the same kind of resins. Further examples are as follows. The resin (or the resin segment) formed with styrene, butyl acrylate and acrylic acid and the resin (or the resin segment) formed with styrene, butyl acrylate, acrylic acid, terephthalic acid, and fumaric acid both have at least a chemical bond constituting polyacrylate. Therefore, these two resins are also the same kind of resins.

The resin component that constitutes the amorphous resin segment is not limited in particular. Examples the resin component are: vinyl resin segment, urethane resin segment, and urea resin segment. Among them, the vinyl resin segment is preferably used, because it can easily control the thermoplastic property.

As a vinyl resin segment, any segments formed by polymerization of a vinyl monomer may be used without limitation. Examples of a vinyl resin segment are: acrylic acid ester resin segment, styrene-acrylic acid ester resin segment, and ethylene-vinyl acetate resin segment. These may be used alone, or may be used in combination of two or more kinds.

Among the above-described vinyl resin segments (amorphous resin segments), from the viewpoint of forming a fine domain structure having a uniform plasticizer, it is preferable to use a styrene-acrylic acid ester resin segment (styrene-acrylic resin segment). Therefore, it will be described the styrene-acrylic resin segment used as the amorphous resin segment in the following.

The styrene-acrylic resin segment is formed by polymerization of a styrene monomer and a (meth)acrylate monomer. Here, "the styrene monomer" includes: styrene having a structure of $CH_2{=}CH{-}C_6H_5$; and compounds having a known side chain or a functional group in the styrene structure. Further, "the (meth)acrylate monomer" includes: an acrylate compound represented by $CH_2{=}CH{-}COOR$ (R: alkyl group) and a methacrylate compound; and compounds having a known side chain or a functional group in the acrylate compound and the methacrylate compound.

In the following, there will be described specific examples of a styrene monomer and a (meth)acrylate monomer that can form the styrene-acrylic resin segment. However, the compounds usable for the formation of the styrene-acrylic resin segment in the present invention are not limited to them.

Specific examples of a styrene monomer are: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

These styrene monomers may be used alone or may be used in combination of two or more kinds.

Specific examples of a (meth)acrylate monomer are: acrylate monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate monomers such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

In the present invention, the term "(meth)acrylate monomer" designates both "acrylate monomer" and "methacrylate monomer". For example, "methyl (meth)acrylate" designates both "methyl acrylate" and "methyl methacrylate".

These acrylate monomers and methacrylate monomers may be used solely or they may be used in combination of two or more kinds. That is, it is possible to form a copolymer using any one of combinations of: a styrene monomer and two or more kinds of acrylate monomers; a styrene monomer and two or more kinds of methacrylate monomers; and a styrene monomer, an acrylate monomer, and a methacrylate monomer.

A content of the constituting unit derived from the styrene monomer in the amorphous resin segment is preferably in the range of 40 to 90 mass % with respect to the total amount of the amorphous resin segment. A content of the constituting unit derived from the (meth)acrylate monomer in the amorphous resin segment is preferably in the range of 10 to 60 mass % with respect to the total amount of the amorphous resin segment. By making the content in the above-described range, it becomes easy to control the thermoplastic property of the hybrid resin.

Further, it is preferable that the amorphous resin segment is formed with other compound in addition to the styrene monomer and the (meth)acrylate monomer. This compound makes a chemical bond to the above-described crystalline polyester resin segment. Specifically, it is preferable to use a compound that forms an ester bond with a hydroxy group originated from the polyhydric alcohol, or a carboxy group originated from the polycarboxylic acid in the above-described crystalline polyester resin segment. Therefore, it is preferable that the amorphous resin segment is formed with a compound capable of doing addition polymerization to the styrene monomer and the (meth)acrylate monomer, and containing a carboxy group or a hydroxy group in the molecule.

Examples of these compounds are: compounds containing a carboxy group such as acrylic acid, methacrylic acid, maleic acid, itaconic acid, cinnamic acid, fumaric acid, maleic acid monoalkyl ester, and itaconic acid monoalkyl; and compounds containing a hydroxy group such as 2-hydroxyethyl (meth)acrylate, 2-hydroxypropyl (meth)acrylate, 3-hydroxypropyl (meth)acrylate, 2-hydroxybutyl (meth) acrylate, 3-hydroxybutyl (meth)acrylate, 4-hydroxybutyl (meth)acrylate, and polyethylene glycol mono (meth)acrylate.

A content of the constituting unit derived from the above-described compound in the amorphous resin segment is preferably in the range of 0.5 to 20 mass % with respect to the total amount of the amorphous resin segment.

A forming method of a styrene-acrylic resin segment is not limited in particular. It can be cited a polymerization method to polymerize a monomer using a publicly known oil-soluble polymerization initiator or a water-soluble polymerization initiator. Specific examples of the oil-soluble polymerization initiator include the following azo-based or diazo-based polymerization initiators and peroxide-based polymerization initiators.

Azo-based or diazo-based polymerization initiators are such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Peroxide-based polymerization initiators are such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

When the resin particles are formed by the emulsion polymerization method, a water-soluble polymerization initiator can be used. Specific examples of the water-soluble polymerization initiator include: persulfates such as potassium persulfate and ammonium persulfate; azobisaminodipropane acetate; azobiscyanovaleric acid and salts thereof; and hydrogen peroxide.

A content of the amorphous resin segment is preferably in the range of 3 to less than 15 mass % based on the total amount of the hybrid resin. More preferably, it is in the range of 5 to less than 10 mass %, and still more preferably, it is in the range of 7 to less than 9 mass %.

(Production Method of Hybrid Resin)

A production method of a hybrid resin according to the present invention is not limited in particular as long as the production method can form a copolymer having a structure containing a molecular bond between the above-described crystalline polyester resin segment and the amorphous resin segment. A specific example of a production method of a hybrid resin is described in the following.

(1) A Method for Producing a Hybrid Resin Having the Following Steps of: Polymerizing an Amorphous Resin Segment at First; and Forming a Crystalline Polyester Resin Segment Under the Presence of the Amorphous Resin Segment.

In this method, an amorphous resin segment is formed with an addition reaction of monomers constituting the above-described amorphous resin segment (preferably, vinyl monomers such as a styrene monomer and a (meth)acrylate monomer).

Subsequently, a polyhydric alcohol component and a polycarboxylic acid component are made to be polycondensed under the presence of the amorphous resin segment to form a crystalline polyester resin segment. During the moment in which a polyhydric alcohol component and a polycarboxylic acid component are made to be polycondensed, the polyhydric alcohol component or the polycarboxylic acid component is made to conduct an addition reaction to the amorphous resin segment. Thus, a hybrid resin is formed.

In the above-described method, it is preferable that the crystalline polyester resin segment and the amorphous resin segment each contain a portion where these two segments can react with each other.

Specifically, during the formation of the amorphous resin segment, in addition to the monomers constituting the amorphous resin segment, it is used a compound containing a portion which can react with a carboxy group (—COOH) or a hydroxy group (—OH) remained in the crystalline polyester resin segment and a portion which can react with the amorphous resin segment. That is, by the reaction of this compound with a carboxy group (—COOH) or a hydroxy group (—OH) remained in the crystalline polyester resin segment, the crystalline polyester resin segment can form a chemical bond with the amorphous resin segment.

Alternatively, during the formation of the crystalline polyester resin segment, it may be used a compound which can react with the polyhydric alcohol component or the polycarboxylic acid component, with the condition that this compound has a portion which can react with the amorphous resin segment.

By using the above-described method, it can form a hybrid resin having a structure of a molecular bond (a graft structure) of the amorphous resin segment bonded with the crystalline polyester resin segment.

(2) A Method for Producing a Hybrid Resin Having the Following Steps of: Respectively Forming a Crystalline Polyester Resin Segment and an Amorphous Resin Segment; and Making to Bond these Two Segments.

In this method, a polyhydric alcohol component and a polycarboxylic acid component are made to be polycondensed to form a crystalline polyester resin segment. Apart from a reaction system to form a crystalline polyester resin segment, an amorphous resin segment is formed by making an addition polymerization of monomers constituting the amorphous resin segment. During this reaction, it is preferable to incorporate portions which can be mutually reacted by the crystalline polyester resin segment and the amorphous resin segment. The method for incorporate such portions which can be reacted is the same as described above, therefore, the detailed explanation is omitted.

Subsequently, by reacting the above-described crystalline polyester resin segment with the amorphous resin segment, it can form a hybrid resin having a structure containing a molecular bond between the crystalline polyester resin segment and the amorphous resin segment.

When the above-described portions which can be reacted are not incorporated in the crystalline polyester resin segment and the amorphous resin segment, it may be formed a co-existing system of the crystalline polyester resin segment and the amorphous resin segment at first, then it may adopt a method of adding a compound having a portion which can be bonded to the crystalline polyester resin segment and the amorphous resin segment. It can from a hybrid resin having a structure containing a molecular bond between the crystalline polyester resin segment and the amorphous resin segment.

(3) A Method for Producing a Hybrid Resin Having the Following Steps of: Forming a Crystalline Polyester Resin Segment at First; and Making Polymerization Reaction to Form an Amorphous Resin Segment Under the Presence of the Crystalline Polyester Resin Segment.

In this method, a polyhydric alcohol component and a polycarboxylic acid component are made to be polycondensed to form a crystalline polyester resin segment at first.

Subsequently, monomers constituting the amorphous resin segment are made to be polymerized to form the amorphous resin segment. During this reaction, in the same manner as in the above-described method (1), it is preferable to incorporate, in the crystalline polyester resin segment and the amorphous resin segment, portions which can be mutually reacted by the crystalline polyester resin segment and the amorphous resin segment. The method for incorporating such portions which can be reacted is the same as described above, therefore, the detailed explanation is omitted.

By using the above-described method, it can form a hybrid resin having a structure of a molecular bond (a graft structure) of the crystalline polyester resin segment bonded with the amorphous resin segment.

Among the production methods (1) to (3) as described above, the production method (1) is preferably used since this method enables to easily form a hybrid resin having a structure of an amorphous resin chain bonded with a crystalline polyester resin chain as a grafted portion, and this method can simplify the production method.

The production method (1) contains the steps of forming an amorphous resin segment at first, then making to bond a crystalline polyester resin segment. Consequently, the orientation of the crystalline polyester resin segment will be uniform. As a result, it can be securely formed a hybrid resin appropriate to the toner according to the present invention. This is a preferable embodiment.

(Other Crystalline Resins)

Usable crystalline resins in the present invention are not limited to the above-described crystalline polyester resins and hybrid resins. Known crystalline resins may be used. Examples of the usable crystalline resins are: a crystalline polyurethane resin, a crystalline polyurea resin, a crystalline polyamide resin, and a crystalline polyether resin described in paragraphs [0056] to [0102] of JP-A No. 2015-011325.

[Production Method of Toner]

A production method of a toner (toner particles) according to the present invention is not limited in particular. It can be cited known polymerization methods such as: a suspension polymerization method, an emulsion polymerization aggregation method, and a dispersion polymerization method.

The toner particles according to the present invention may have a core-shell structure in which the surface of the core particle made of a core resin is covered with a shell layer made of a shell layer. It may have a monolayer structure. When a core-shell structure is used, it is preferable that the shell resin is an amorphous resin.

The obtained dried toner particles may be used directly as a toner. It may be added a known external additive to the toner particles by mixing under a dry condition. It is possible to use them as a toner.

For mixing the external additive, it may be used a various known mixing machines such as a turbular mixer, a Henschel mixer, a Nouter mixer, and a V-type mixer.

A method of producing a toner according to the present invention will be described by specifically describing a method of producing a yellow toner in the following. The method of producing the yellow toner is suitably applied to the methods of producing toners other than the yellow toner (for example, a magenta toner, a cyan toner, and a black toner) by changing the used coloring agent.

The method of producing a toner according to the present invention is not limited to the method described in the following.

<Preparation of Aqueous Dispersion Liquid of Coloring Agent Particles>

Sodium dodecyl sulfate was added to ion-exchanged water. To this was added a yellow coloring agent, and the mixture was subjected to a dispersion treatment. Thus, it was obtained an aqueous dispersion liquid of coloring agent particles of the yellow coloring agent.

<Preparation of Aqueous Dispersion Liquid of Amorphous Vinyl Polymer Containing Releasing Agent>

(1) First Step Polymerization

Into a reaction vessel equipped with a stirrer, a temperature sensor, a cooling tube and a nitrogen introducing device, sodium dodecyl sulfate and ion-exchanged water are charged. While stirring under nitrogen flow, the inner temperature is raised.

After the temperature is raised, potassium persulfate (KPS) dissolved in ion-exchanged water is added thereto, and a monomer mixture composed of the following is dropwise added: styrene (St) (as a styrene monomer); n-butyl acrylate (BA) (as an acrylate monomer); and methacrylic acid (MAA) (as a compound having a carboxy group [—COOH] or a hydroxy group [—OH]).

Then, the reaction system is heated and stirred to carry out the polymerization (first step polymerization). A dispersion liquid of resin fine particles (1) is thus prepared.

(2) Second Step Polymerization

Into a reaction vessel equipped with a stirrer, a temperature sensor, a cooling tube and a nitrogen introducing tube, a solution of sodium polyoxyethylene (2) dodecyl ether sulfate dissolved in ion-exchanged water is charged. After heating the solution, there are added the above-described dispersion liquid (1) of the resin fine particles, a monomer mixture composed of: styrene (St) (a styrene monomer); n-butyl acrylate (BA) (a (meth)acrylate monomer); methacrylic acid (MAA) (a compound having a carboxy group [—COOH], or a hydroxy group [—OH]); and n-octyl-3-mercapto propionate, and behenyl behenate (mp. 73° C.; a releasing agent). The reaction system is mixed and dispersed so that a dispersion containing emulsion particles (oil particles) is prepared.

Then, an initiator solution of potassium persulfate (KPS) dissolved in ion-exchanged water is added to the dispersion, and the system is heated and stirred to carry out polymerization (second step polymerization). A dispersion liquid (2) of resin fine particles is thus prepared.

(3) Third Step Polymerization

To the dispersion liquid (2) of resin fine particles is added ion-exchanged water, and the system is fully mixed. Then, a solution of potassium persulfate (KPS) dissolved in ion-exchanged water is added thereto. A monomer mixture composed of: styrene (St) (a styrene monomer); n-butyl acrylate (BA) (a (meth)acrylate monomer); methacrylic acid (MAA) (a compound having a carboxy group [—COOH], or a hydroxy group [—OH]); and n-octyl-3-mercapto propionate, is added dropwise thereto.

After addition, the system is heated and stirred to carry out the polymerization (third step polymerization), and then the system is cooled. An aqueous dispersion liquid of an amorphous vinyl polymer containing a releasing agent is thus prepared.

<Preparation of Aqueous Dispersion Liquid of Crystalline Polyester Resin>

(Synthesis of Crystalline Polyester Resin)

Into a dropping funnel are placed raw material monomers for producing an addition polymerization resin segment (here, a styrene-acrylic resin segment is produced) and a radical polymerization initiator. For example, styrene, n-butyl acrylate, methacrylic acid, and di-tert-butyl peroxide (as a polymerization initiator) are placed in the dropping funnel.

Into a 4 necked reaction vessel equipped with a stirrer, a nitrogen introducing device, a temperature sensor, and a cooling tube are placed raw material monomers for producing a polycondensation resin segment (here, crystalline polyester resin segment is produced). For example, sebacic acid (an aliphatic dicarboxylic acid) and 1,12-dodecandiol (an aliphatic diol) are placed therein, and the mixture is heated to dissolve.

Subsequently, the raw material monomers for producing a polycondensation resin segment and a radical polymerization initiator in the dropping funnel are added dropwise with stirring. After conducting aging, the unreacted addition reaction monomers are removed under a reduced pressure.

Afterward, an esterification catalyst is added, and the temperature of the mixture is raised so that the system is reacted. Then, the reaction is further continued under the reduced pressure.

Subsequently, the mixture is cooled and the system is reacted under the reduced pressure. Thus, a hybrid resin of a crystalline polyester resin is obtained.

(Preparation of Aqueous Dispersion Liquid of Crystalline Polyester Resin)

The crystalline polyester resin produced in the above-described synthetic example is dissolved in a solvent (such as methyl ethyl ketone) with stirring. Then, an aqueous solution of sodium hydroxide is added to the dissolved solution. While stirring the dissolved solution, water is dropwise added and mixed to prepare an emulsion.

Subsequently, by removing the solvent from this emulsion, it can be prepared an aqueous dispersion liquid in which the crystalline polyester resin is dispersed.

<Preparation of Aqueous Dispersion Liquid of Amorphous Polyester Resin>

(Preparation of Amorphous Polyester Resin)

Into a reaction vessel equipped with a nitrogen introducing tube, a dehydration tube, a stirrer, and a thermocouple are placed: a bisphenol A propylene oxide 2 mole adduct; terephthalic acid; fumaric acid; and an esterification catalyst (for example, tin octylate). Then, a condensation polymerization reaction is conducted. The reaction is further conducted under the reduced pressure, and the reaction mixture is cooled. Subsequently, a monomer mixture composed of: methacrylic acid (MAA) (a compound having a carboxy group [—COOH], or a hydroxy group [—OH]); styrene (St); (a styrene monomer); and n-butyl acrylate (BA) (a (meth)acrylate monomer), and a polymerization initiator (for example, di-tert-butyl peroxide) are dropwise added. After addition, an addition polymerization reaction is conducted, then the temperature of the reaction mixture is raised and the temperature is kept under the reduced pressure. Subsequently, the compound having a carboxy group [—COOH], or a hydroxy group [—OH], the styrene monomer, and the (meth)acrylate monomer are removed to synthesize an amorphous polyester resin having a vinyl resin segment and a crystalline polyester segment bonded with each other.

(Preparation of Aqueous Dispersion Liquid of Amorphous Polyester Resin)

The amorphous polyester resin produced in the above-described synthetic example is dissolved in a solvent (such as methyl ethyl ketone) with stirring. Then, an aqueous solution of sodium hydroxide is added to the dissolved solution. While stirring the dissolved solution, water is dropwise added and mixed to prepare an emulsion.

Subsequently, by removing the solvent from this emulsion, it can be prepared an aqueous dispersion liquid in which the amorphous polyester resin is dispersed.

<Preparation of Yellow Toner>

Into a reaction vessel equipped with a stirrer, a temperature sensor and a cooling tube, an aqueous dispersion liquid of an amorphous vinyl polymer containing a releasing agent and ion-exchanged water are charged. Thereafter, the pH is adjusted by adding an aqueous sodium hydroxide solution.

Thereafter, an aqueous dispersion liquid of coloring agent fine particles is added thereto. Then, while stirring, an aqueous solution of magnesium chloride is added. The temperature of the system is raised, and an aqueous dispersion liquid of a crystalline polyester resin is added to allow the particle growth reaction to continue. At the moment when the particle size becomes to a required value, an aqueous dispersion liquid of an amorphous polyester resin is added. Then, an aqueous solution made of sodium chloride dissolved in ion-exchanged water is added to terminate the particle growth. Then, the reaction system is further heated and stirred to allow fusion of the particles to proceed. Afterwards, the system is cooled.

Then, solid-liquid separation is carried out, and a dewatered toner cake is washed. Thereafter, the toner cake is dried to yield yellow toner particles. By adding an external additive to the obtained toner particles, a yellow toner is prepared.

(Preparation Method of Yellow Developer)

A yellow developer is prepared by adding a known ferrite carrier to the above-described yellow toner.

[Electrophotographic Image Forming Method]

An electrophotographic image forming method uses a plurality of the color toners as described above. It contains at least: a charging step; an exposing step; a developing step; and a transferring step.

These steps are described in the following.

[Charging Step]

In this step, an electrophotographic photoreceptor is charged. A method for charging is not limited in particular. For example, it may be used a known method such as a charge roller method that charges an electrophotographic photoreceptor with a charge roller.

[Exposing Step]

In this step, an electrostatic latent image is formed on the electrophotographic photoreceptor (a support of an electrostatic latent image). An electrophotographic photoreceptor is not limited in particular. For example, it may be used a drum type photoreceptor composed of an organic photoreceptor such as polysilane and phthalopolymethine.

Formation of an electrostatic latent image is done: by uniformly charging the surface of the electrophotographic photoreceptor in the charging step; and then, by imagewise exposing the surface of the electrophotographic photoreceptor in the exposing step.

An exposing device is not limited in particular. It may be used an exposing device generally used in an electrophotographic method.

[Developing Step]

A developing step is a process to develop the electrostatic latent image with a dry developer containing the toner according to the present invention to form a toner image.

Formation of the toner image is done by using a dry developer containing the toner. It is done by using a developing device composed of: a stirrer to charge the toner with friction stirring; and a rotatable magnet roller.

Specifically, in the developing device, the toner and the carrier are stirred to be mixed. During that time, the toner is charged by friction. The toner is retained on the surface of the rotating magnet roller to form a magnetic brush. Since the magnet roller is arranged in the vicinity of the electrophotographic photoreceptor (a support of an electrostatic latent image), a part of toner constituting the magnetic brush formed on the surface of the rotating magnet roller is moved to the surface of the photoreceptor by the electric attraction. As a result, the electrostatic latent image is developed by the toner to form a toner image on the surface of the photoreceptor.

[Transferring Step]

In this step, the toner image is transferred to an image support. Transfer of the toner image to the image support is done by conducting peeling electrification of the image to the image support. As a transferring device, it may be used; a corona transferring device with a corona discharge; a transfer belt; and a transfer roller.

The transferring step may be done by the following. By using an intermediate transfer member, a toner image is transferred at first to the intermediate transfer member, and then, this toner image is secondly transferred to an image support. Otherwise, it may form an image by directly transferring the toner image formed on the electrophotographic photoreceptor (a support of an electrostatic latent image) to the image support.

The image support is not limited in particular. It may be used a various materials such as: a plain paper from thin paper to thick paper, a high quality paper, a printing paper of an art paper and a coat paper, a commercially available Japanese paper and a post card paper, a plastic film for OHP, and a cloth.

[Cleaning Step]

In this step, the developer on the developer support member such as the developing roller, the photoreceptor, and the intermediate transfer member, which is not used for formation of the image and remained thereon, is removed from the developer support member.

A cleaning method is not limited in particular. A preferable method is to use a blade that rubs the surface of the photoreceptor by locating at the position from which the edge portion of the blade abuts the photoreceptor.

<<Full Color Toner Set for Developing Electrostatic Image>>

A full color toner set for developing an electrostatic image is not limited in particular, as long as the toner set is composed of a plurality of color toners including the above-described coloring agents. Preferably, the toner set is composed of at least 4 color toners of a yellow toner, a magenta toner, a cyan toner, and a black toner.

In the full color toner set for developing an electrostatic image (hereafter, it is also simply called as "a toner set") according to the present invention, the above-described toners of the present invention are suitably used.

That is, the full color toner set for developing an electrostatic image according to the present invention is a full color toner set containing a plurality of color toners, wherein the plurality of color toners each respectively contain toner particles including a binder resin, a coloring agent, a releasing agent, and a crystalline resin; the binder resin contains an amorphous vinyl polymer formed with a vinyl monomer; the toner particles contain the amorphous vinyl polymer in the range of 10 to 90 mass %; and a maximum value of an acid value difference of the color toners is in the range of 1 to 10 mg KOH/g.

One of preferable embodiments of the full color toner set for developing an electrostatic image according to the present invention is that: the amorphous vinyl polymer is a styrene-acrylic resin; and the styrene-acrylic resin contains a structural unit derived from an alkyl (meth)acrylate monomer represented by Formula (1). This embodiment is preferable to obtain excellent low-temperature fixability and thermal resistivity.

$$H_2C{=}CR^1{-}COOR^2 \qquad \text{Formula (1):}$$

wherein $R^1$ represents a hydrogen atom or a methyl group; and $R^2$ represents an alkyl group of 6 to 22 carbon atoms.

Further, another preferable embodiment of the full color toner set for developing an electrostatic image according to the present invention is that $R^2$ in Formula (1) represents a branched alkyl group of 6 to 22 carbon atoms. This embodiment is preferable to obtain excellent low-temperature fixability and thermal resistivity.

Another preferable embodiment of the full color toner set for developing an electrostatic image according to the present invention is that the toner particles in the plurality of color toners contain the amorphous vinyl polymer in the range of 50 to 80 mass %. This embodiment is preferable to improve a document offset property.

Another preferable embodiment of the full color toner set for developing an electrostatic image according to the present invention is that the crystalline resin is a crystalline polyester resin. This embodiment is preferable to improve low-temperature fixability.

Another preferable embodiment of the full color toner set for developing an electrostatic image according to the present invention is that the crystalline polyester resin is a hybrid resin having an amorphous resin segment bonded with a chemical bond. This embodiment is preferable to improve low-temperature fixability.

The applicable embodiments of the present invention are not limited to the embodiments described-above. They may be suitably changed within the scope of not exceeding the object of the present invention.

EXAMPLES

Hereinafter, specific examples of the present invention will be described by referring to specific examples, but the present invention is not limited thereto. In the present examples, the description of "parts" or "%" is used, it represents "mass parts" or "mass %" unless specific notice is given.

Preparation Method of Toner Set 1: Example 1

<<Preparation Method of Yellow Toner (Y-1)>>

<Preparation of Aqueous Dispersion Liquid (Y) of Coloring Agent Fine Particles>

A solution of 90 mass parts of sodium dodecyl sulfate dissolved in 1,600 mass parts of ion-exchanged water was prepared. While stirring this solution, 420 mass parts of C. I. Pigment Yellow 74 (coloring agent) were gradually added to the solution. Then, a mechanical disperser "CLEARMIX" (M Technique Co., Ltd.) was used for making a dispersion treatment. Thus, it was prepared an aqueous dispersion liquid (Y) of yellow coloring agent fine particles. The particle size of the coloring agent fine particles was measured with "Microtrac UPA-150" (made by Nikkiso Co., Ltd.). It was found to be 182 nm.

<Preparation of Aqueous Dispersion Liquid (WV1) of Amorphous Vinyl Polymer Containing Releasing Agent (wv1)>

(1) First Step Polymerization

Into a 5 L reaction vessel equipped with a stirrer, a temperature sensor, a cooling tube and a nitrogen introducing device, 8 mass parts of sodium dodecyl sulfate and 3,000 mass parts of ion-exchanged water were charged. While stirring at a stirring speed of 230 rpm under nitrogen flow, the inner temperature was raised to 80° C.

After the temperature was raised, a solution of 10 mass parts of potassium persulfate (KPS) dissolved in 200 mass parts of ion-exchanged water was added thereto, and the liquid temperature was raised again to 80° C. A monomer mixture composed of the following was added thereto dropwise over a period of 1 hour.

| | |
|---|---|
| Styrene (St) | 480 mass parts; |
| n-Butyl acrylate (BA) | 250 mass parts; and |
| Methacrylic acid (MAA) | 68 mass parts |

Then, the reaction system was heated and stirred at 80° C. for 2 hours to carry out the polymerization (first step polymerization). A dispersion liquid (1) of resin fine particles was thus prepared.

(2) Second Step Polymerization

Into a 5 L reaction vessel equipped with a stirrer, a temperature sensor, a cooling tube and a nitrogen introducing device, a solution of 7 mass parts of sodium polyoxyethylene (2) dodecyl ether sulfate dissolved in 3,000 mass parts of ion-exchanged water was charged. After heating to 98° C., 280 mass parts of the dispersion liquid (1) of the resin fine particles, a monomer mixture composed of:

| | |
|---|---|
| styrene (St) | 256 mass parts; |
| 2-ethylhexyl acrylate (an acryl ester described in Table 1) | 115 mass parts; |
| methacrylic acid (MAA) | 21 mass parts; and |
| n-octyl-3-mercaptopropionate | 5 mass parts, |

and as a releasing agent, 120 mass parts of behenyl behenate (mp. 73° C.) melted at 90° C. were added. The reaction system was mixed and dispersed for 1 hour by using a mechanical disperser with a circulation route "CLEARMIX" (M Technique Co., Ltd.) so that a dispersion liquid containing emulsion particles (oil particles) was prepared.

Subsequently, an initiator solution of 6 mass parts of potassium persulfate (KPS) dissolved in 200 mass parts of ion-exchanged water was added to the dispersion liquid, and the system was heated and stirred at 84° C. for 1 hour to carry out polymerization (second step polymerization). A dispersion liquid (2) of resin fine particles was thus prepared.

(3) Third Step Polymerization

To the dispersion liquid (2) of resin fine particles was added 400 mass parts of ion-exchanged water and mixed well, then, a solution of 11 mass parts of potassium persulfate (KPS) dissolved in 400 mass parts of ion-exchanged water was added. A monomer mixture composed of the following was dropwise added thereto at a temperature of 82° C. over a period of 1 hour.

| | |
|---|---|
| Styrene (St) | 435 mass parts, |
| n-Butyl acrylate (BA) | 157 mass parts; |
| Methacrylic acid (MAA) | 41 mass parts; and |
| n-Octylmercaptan | 13 mass parts, |

After addition, the system was heated and stirred for 2 hours to carry out the polymerization (third step polymerization), and then the system was cooled to 28° C. Thus, an aqueous dispersion liquid (WV1) of an amorphous vinyl polymer containing releasing agent (wv1) was prepared. In this aqueous dispersion liquid (WV1) of an amorphous vinyl polymer containing releasing agent (wv1), the resultant vinyl resin particles (X) had a volume median particle size ($d_{50}$) of 220 nm, a glass transition temperature (Tg) of 55° C., and a weight average molecular weight (Mw) of 38,000.

<Preparation of Aqueous Dispersion Liquid (C1) of Crystalline Polyester Resin (c1)>>

(Synthesis of Crystalline Polyester Resin (c1))

Raw material monomers for an addition polymerization resin (styrene-acrylic resin: StAc) segment including a bireactive monomer and a radical polymerization initiator as described below were loaded in a dropping funnel.

| | |
|---|---|
| Styrene | 34 mass parts |
| n-Butyl acrylate | 12 mass parts |
| Acrylic acid | 2 mass parts |
| Di-t-butyl peroxide (polymerization initiator) | 7 mass parts |

The following raw material monomers for a poly-condensation resin (crystalline polyester resin: CPEs) segment were introduced in a four-necked flask equipped with a nitrogen introducing tube, a dehydration tube, a stirrer, and a thermocouple. Then, the mixture was heated to 170° C. to dissolve the content.

| | |
|---|---|
| Sebacic acid | 281 mass parts |
| 1,12-Dodecanediol | 283 mass parts |

Subsequently, the raw material monomers for an addition polymerization resin (styrene-acrylic resin: StAc) segment and the radical polymerization initiator loaded in a dropping funnel were dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw material monomers for the above-described resin.

Then, 0.8 mass parts of tetrabutyl orthotitanate ($Ti(OBu)_4$) were added as an esterification catalyst, and the mixture was heated to 235° C. The reaction was done under a normal pressure (101.3 kPa) for 5 hours, then further, the reaction was done under a reduced pressure (8 kPa) for 1 hour.

Subsequently, the reaction mixture was cooled to 200° C., and the reaction was made under a reduced pressure (20 kPa) for 1 hour. Thus, a crystalline polyester resin (c1) of a hybrid resin was obtained.

The obtained hybrid crystalline polyester resin (c1) contained a styrene-acrylic resin segment in an amount of 8 mass %, and it was a resin having a structure in which the crystalline polyester resin segment was grafted to the styrene-acrylic resin segment. It had a number average molecular weight (Mn) of 9,000 and a melting point ($T_c$) of 76° C.

(Preparation of Aqueous Dispersion Liquid (C1) of Crystalline Polyester Resin (c1))

72 mass parts of the crystalline polyester resin (c1) obtained in the above-described synthetic example were added in 72 mass parts of methyl ethyl ketone, and the mixture was stirred at 70° C. for 30 minutes to dissolve. Then, 2.5 mass parts of 25 mass % of aqueous sodium hydroxide solution were added thereto. This dissolved solution was placed in a reaction vessel having a stirrer. While stirring, 252 mass parts of water heated at 70° C. was dropwise added over a period of 70 minutes. In the course of dropwise addition, the liquid in the reaction vessel became cloudy, and a uniform emulsified state was achieved after completion of addition. A volume average particle size of the oil particles contained in the emulsified liquid was measured with a laser diffraction particle size distribution meter "LA-750" (made by HORIBA Co. Ltd.). The volume average particle was found to be 123 nm.

Subsequently, while keeping this emulsion at 70° C., the reaction mixture was stirred for 3 hours under a reduced pressure of 15 kPa (150 mbar) by using a diaphragm vacuum pump "V-700" (made by BUCHI Co. Ltd.). During this step, methyl ethyl ketone was removed to prepare an aqueous dispersion liquid (C1) of a crystalline polyester resin (c1). The particles contained in the aqueous dispersion liquid had a volume average particle size of 75 nm measured with the above-described particle size distribution meter.

<Preparation of Aqueous Dispersion Liquid (A1) of Amorphous Polyester Resin (a1)>

(Synthesis of Amorphous Polyester Resin (a1))

Into a reaction vessel equipped with a nitrogen introducing tube, a dehydration tube, a stirrer, and a thermocouple were placed the following materials.

| | |
|---|---|
| Bisphenol A propylene oxide 2 mole adduct | 500 mass parts |
| Terephthalic acid | 117 mass parts |

-continued

| | |
|---|---|
| Fumaric acid | 82 mass parts |
| Tin octylate (esterification catalyst) | 2 mass parts. |

The mixture was heated to 230° C. for 8 hours to carry out a condensation polymerization, then further, the reaction was continued at a pressure of 8 kPa for 1 hour. After cooling the reaction mixture to 160° C., the following mixture was added through a dropping funnel over a period of 1 hour.

| | |
|---|---|
| Acrylic acid | 10 mass parts |
| Styrene | 6 mass parts |
| n-Butyl acrylate | 1 mass part |
| Di-t-butyl peroxide (polymerization initiator) | 10 mass parts |

After dropwise addition, the temperature of the mixture was kept to 160° C. and the addition polymerization was continued for 1 hour. Then, the temperature of the mixture was raised to 200° C., and the mixture was kept at a reduced pressure of 10 kPa for 1 hour. By removing acrylic acid, styrene, and butyl acrylate, it was obtained an amorphous polyester resin (a1) having a vinyl resin segment and a crystalline polyester segment bonded with each other.

(Preparation of Aqueous Dispersion Liquid (A1) of Amorphous Polyester Resin (a1))

72 mass parts of the crystalline polyester resin (a1) obtained in the above-described synthetic example were added in 72 mass parts of methyl ethyl ketone, and the mixture was stirred at 30° C. for 30 minutes to dissolve. Then, 2.5 mass parts of 25 mass % of aqueous sodium hydroxide solution were added thereto. This dissolved solution was placed in a reaction vessel having a stirrer. While stirring, 252 mass parts of water heated at 30° C. was dropwise added over a period of 70 minutes. In the course of dropwise addition, the liquid in the reaction vessel became cloudy, and a uniform emulsified state was achieved after completion of addition. A volume average particle size of the oil particles contained in the emulsified liquid was measured with a laser diffraction particle size distribution meter "LA-750" (made by HORIBA Co. Ltd.). The volume average particle size was found to be 186 nm.

Subsequently, while heating this emulsion to 70° C., the reaction mixture was stirred for 3 hours under a reduced pressure of 15 kPa (150 mbar) by using a diaphragm vacuum pump "V-700" (made by BUCHI Co. Ltd.). During this step, methyl ethyl ketone was removed to prepare an aqueous dispersion liquid (A1) of an amorphous crystalline polyester resin (a1). The particles contained in the aqueous dispersion liquid had a volume average particle size of 159 nm measured with the above-described particle size distribution meter.

<Preparation of Yellow Toner (Y-1)>

Into a reaction vessel equipped with a stirrer, a temperature sensor, and a cooling tube, 231 mass parts (in solid fraction) of the aqueous dispersion liquid (WV1) of an amorphous vinyl polymer (wv1) and 2,000 mass parts of ion-exchanged water were charged. Thereafter, the pH was adjusted to 10 (the liquid temperature of 25° C.) by adding a 5 mol/L aqueous sodium hydroxide solution.

Thereafter, 23 mass parts (in solid fraction) of the aqueous dispersion liquid (Y) of coloring agent fine particles was added thereto. Then, while stirring, an aqueous solution of 30 mass parts of magnesium chloride dissolved in 30 mass parts of ion-exchanged water was added at 30° C. over a period of 10 minutes. The temperature of the system was raised to 80° C., and 30 mass parts of the aqueous dispersion liquid (C1) of a crystalline polyester resin (c1) was added over a period of 10 minutes to allow the particle growth reaction to continue. The particle size of the aggregated particles was measured by using a "Coulter Multisizer 3" (Beckman Coulter, Inc.). When the volume median particle size reached 6.0 μm, 60 mass parts of the aqueous dispersion liquid (A1) of an amorphous polyester resin (a1) were added over a period of 30 minutes. When the supernatant liquid of the reaction mixture became transparent, an aqueous solution made of 190 mass parts of sodium chloride dissolved in 760 mass parts of ion-exchanged water was added to terminate the particle growth.

Then, the reaction system was further heated and stirred at 80° C. to allow fusion of the particles to proceed. When the average circularity of the toner reached 0.945, the reaction system was cooled to 30° C. at a cooling rate of 25° C./min. The average circularity of the toner was measured with a measuring apparatus "FPIA-2100" (Sysmex Corp.) (HPF detect number of 4,000).

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield yellow toner particles.

To 100 mass parts of the obtained toner particles, 0.6 mass parts of hydrophobic silica (number average primary particle size=12 nm, hydrophobicity=68) and 1.0 mass part of hydrophobic titanium oxide (number average primary particle size=20 nm, hydrophobicity=63) were added as external additives, and the mixture was mixed for 20 minutes at 32° C. by using a "Henschel mixer" in the condition of a rotary blade circumferential speed of 35 mm/sec. Then, a sieve having an opening of 45 μm was used to remove coarse particles. Thus, by conducting an external additive treatment, a yellow toner (Y-1) was prepared.

<<Preparation Method of Yellow Developer (Y-1)>>

A silicone covered ferrite carrier having a volume average particle size of 60 μm was added and mixed with the yellow toner (Y-1) so that the concentration of the toner becomes 6 mass %. Thus, a yellow developer (Y-1) was prepared.

<<Preparation Method of Magenta Developer (M-1)>>

A magenta developer (M-1) was obtained by using a toner prepared in the same manner as preparation of the yellow toner (Y-1) except the following change. The coloring agent C.I. Pigment Red 122 was used in place of C.I. Pigment Yellow 74, and an aqueous dispersion liquid (WV10) of an amorphous vinyl polymer containing a releasing agent was used in place of an aqueous dispersion liquid (WV1) of an amorphous vinyl polymer containing a releasing agent (wv1). The composition of the aqueous dispersion liquid (WV10) is indicated in Table 1: an acrylate in the second step polymerization was changed, and amounts of styrene (St), n-butyl acrylate (BA), and methacrylic acid (MAA) in a monomer mixture were made as described in Table 1.

<<Preparation Method of Cyan Developer (C-1)>>

A cyan developer (C-1) was obtained by using a toner prepared in the same manner as preparation of the yellow toner (Y-1) except the following changes. The coloring agent C.I. Pigment Blue 18:3 was used in place of C.I. Pigment Yellow 74, and an aqueous dispersion liquid (WV9) of an amorphous vinyl polymer containing a releasing agent was used in place of an aqueous dispersion liquid (WV1) of an amorphous vinyl polymer containing a releasing agent (wv1). The composition of the aqueous dispersion liquid (WV9) is indicated in Table 1: an acrylate in the second step polymerization was changed, and amounts of styrene (St), n-butyl acrylate (BA), and methacrylic acid (MAA) in a monomer mixture were made as described in Table 1.

<<Preparation Method of Black Developer (Bk-1)>>

A black developer (Bk-1) was obtained by using a toner prepared in the same manner as preparation of the yellow toner (Y-1) except the following change. A carbon black was used in place of C.I. Pigment Yellow 74, and an aqueous dispersion liquid (WV9) of an amorphous vinyl polymer containing a releasing agent was used in place of an aqueous dispersion liquid (WV1) of an amorphous vinyl polymer containing a releasing agent (wv1). The composition of the aqueous dispersion liquid (WV9) is indicated in Table 1: an acrylate in the second step polymerization was changed, and amounts of styrene (St), n-butyl acrylate (BA), and methacrylic acid (MAA) in a monomer mixture were made as described in Table 1.

TABLE 1

| Aqueous dispersion liquid No. of amorphous vinyl polymer containing releasing agent | Second step polymerization Kind of acrylic ester | Third step polymerization St (g) | BA (g) | MAA (g) |
|---|---|---|---|---|
| WV1 | 2-Ethylhexyl acrylate | 435 | 157 | 41 |
| WV2 | 2-Ethylhexyl acrylate | 446 | 154 | 33 |
| WV3 | 2-Ethylhexyl acrylate | 421 | 160 | 52 |
| WV4 | n-Octyl acrylate | 435 | 157 | 41 |
| WV5 | Behenyl acrylate | 435 | 157 | 41 |
| WV6 | Cellothyl acrylate | 435 | 157 | 41 |
| WV7 | n-Butyl acrylate | 435 | 157 | 41 |
| WV8 | 2-Ethylhexyl acrylate | 458 | 150 | 25 |
| WV9 | 2-Ethylhexyl acrylate | 416 | 162 | 55 |
| WV10 | 2-Ethylhexyl acrylate | 429 | 158 | 46 |
| WV11 | n-Octyl acrylate | 429 | 158 | 46 |
| WV12 | Behenyl acrylate | 429 | 158 | 46 |
| WV13 | Cellothyl acrylate | 429 | 158 | 46 |
| WV14 | n-Butyl acrylate | 429 | 158 | 46 |
| WV15 | 2-Ethylhexyl acrylate | 408 | 164 | 61 |
| WV16 | n-Octyl acrylate | 416 | 162 | 55 |
| WV17 | Behenyl acrylate | 416 | 162 | 55 |
| WV18 | Cellothyl acrylate | 416 | 162 | 55 |
| WV19 | n-Butyl acrylate | 416 | 162 | 55 |
| WV20 | 2-Ethylhexyl acrylate | 397 | 167 | 69 |

Preparation Method of Toner Sets 2 to 13: Examples 2 to 9, and Comparative Examples 1 to 4

Toner sets 2 to 13 were prepared in accordance with a combination of color toners (yellow, magenta, cyan, and black) containing a coloring agent as listed in Table 2.

TABLE 2

| | Toner set No. | Color toner Yellow | Magenta | Cyan | Black |
|---|---|---|---|---|---|
| Example 1 | 1 | Y-1 | M-1 | C-1 | Bk-1 |
| Example 2 | 2 | Y-2 | M-1 | C-2 | Bk-1 |
| Example 3 | 3 | Y-3 | M-2 | C-1 | Bk-1 |
| Example 4 | 4 | Y-4 | M-3 | C-3 | Bk-2 |
| Example 5 | 5 | Y-5 | M-4 | C-4 | Bk-3 |
| Example 6 | 6 | Y-6 | M-5 | C-5 | Bk-4 |
| Example 7 | 7 | Y-7 | M-6 | C-6 | Bk-5 |
| Example 8 | 8 | Y-8 | M-7 | C-7 | Bk-6 |
| Example 9 | 9 | Y-9 | M-8 | C-8 | Bk-7 |
| Comparative example 1 | 10 | Y-10 | M-9 | C-9 | Bk-8 |
| Comparative example 2 | 11 | Y-11 | M-10 | C-10 | Bk-9 |

TABLE 2-continued

| | Toner set No. | Color toner Yellow | Magenta | Cyan | Black |
|---|---|---|---|---|---|
| Comparative example 3 | 12 | Y-12 | M-1 | C-11 | Bk-1 |
| Comparative example 4 | 13 | Y-13 | M-11 | C-1 | Bk-1 |

<<Preparation Method of Yellow Toners (Y-2) to (Y-8), (Y-10), (Y-12), and (Y-13)>>

Yellow toners (Y-2) to (Y-8), (Y-10), (Y-12), and (Y-13) were obtained in the same manner as preparation of the yellow toner (Y-1) except the following change. The kind and the amount of an aqueous dispersion liquid of an amorphous vinyl polymer containing a releasing agent, the amount of the aqueous dispersion liquid (C1) of a crystalline polyester resin (c1), and the amount of the aqueous dispersion liquid (A1) of an amorphous polyester resin (a1) were changed as described in Table 3.

The yellow toner (Y-8) does not contain the aqueous dispersion liquid (A1) of an amorphous polyester resin (a1) used for preparation of the yellow toner (Y-1). The yellow toner (Y-8) does not contain the amorphous polyester resin (a1).

The yellow toner (Y-10) does not contain the aqueous dispersion liquid (C1) of a crystalline polyester resin (c1) used for preparation of the yellow toner (Y-1). The yellow toner (Y-10) does not contain the crystalline polyester resin (c1).

The aqueous dispersion liquid of an amorphous vinyl polymer containing a releasing agent in Table 3 was prepared in the same manner as described in the above-described portion of "<Preparation of aqueous dispersion liquid (WV1) of amorphous vinyl polymer containing releasing agent (wv1)>" except the following change. The kind of an acrylate used in the second step polymerization, and the amounts of styrene (St), n-butyl acrylate (BA), and methacrylic acid (MAA) used in the third step polymerization were changed as described in Table 1.

<<Preparation Method of Yellow Toner (Y-9)>>

<Preparation of Aqueous Dispersion Liquid (V1) of Amorphous Vinyl Polymer (v1)>

An aqueous dispersion liquid (V1) of an amorphous vinyl polymer (v1) was obtained in the same manner as preparation of the aqueous dispersion liquid (WV1) of an amorphous vinyl polymer containing a releasing agent (wv1) except that the releasing agent was not used in the second step polymerization.

<Preparation of Aqueous Dispersion Liquid (W1) of Releasing Agent (w1)>>

72 mass parts of behenyl behenate (releasing agent) were added in 72 mass parts of methyl ethyl ketone, and the mixture was stirred at 78° C. for 30 minutes to dissolve. Then, this solution was placed in a reaction vessel equipped with a stirrer. While stirring, 252 mass parts of heated water at 78° C. were added to the solution. The solution was subjected to an ultrasonic dispersing treatment for 30 minutes using an ultrasonic homogenizer "US-150T" (made by Nippon Seiki Co. Ltd.) with V-LEVEL at 300 μA. Thus, an emulsion was obtained.

Subsequently, this emulsion was heated to 70° C., and it was stirred for 3 hours under a reduced pressure of 15 kPa (150 mbar) by using a diaphragm vacuum pump "V-700" (made by BUCHI Co. Ltd.) to remove methyl ethyl ketone. Thus, it was prepared an aqueous dispersion liquid (W1) of a releasing agent (w1) (behenyl behenate). The particle size of the particles contained in the emulsion was measured with a laser diffraction particle size distribution meter "LA-750" (made by HORIBA Co. Ltd.). The volume average particle was found to be 170 nm.

<Preparation of Yellow Toner (Y-9)>

A yellow toner (Y-9) was obtained in the same manner as preparation of the yellow toner (Y-1) except the following change. The combination of the aqueous dispersion liquid (A1) of an amorphous polyester resin (a1) and the aqueous dispersion liquid (W1) of a releasing agent (w1) was used in place of the aqueous dispersion liquid (WV1) of an amorphous vinyl polymer containing the releasing agent (wv1), further, the aqueous dispersion liquid (V1) of an amorphous

TABLE 3

| Yellow toner | Toner acid value (mg KOH/g) | Aqueous dispersion liquid of amorphous vinyl polymer containing releasing agent No. | Added amount (Mass parts: in solid fraction) | Aqueous dispersion liquid of crystalline polyester resin No. | Added amount (Mass parts: in solid fraction) | Aqueous dispersion liquid of amorphous polyester resin No. | Added amount (Mass parts: in solid fraction) | Aqueous dispersion liquid of amorphous vinyl polymer No. | Added amount (Mass parts: in solid fraction) | Aqueous dispersion liquid of releasing agent No. | Added amount (Mass parts: in solid fraction) |
|---|---|---|---|---|---|---|---|---|---|---|---|
| Y-1 | 27 | WV1 | 231 | C1 | 30 | A1 | 60 | — | — | — | — |
| Y-2 | 24 | WV2 | 231 | C1 | 30 | A1 | 60 | — | — | — | — |
| Y-3 | 31 | WV3 | 231 | C1 | 30 | A1 | 60 | — | — | — | — |
| Y-4 | 27 | WV4 | 231 | C1 | 30 | A1 | 60 | — | — | — | — |
| Y-5 | 27 | WV5 | 231 | C1 | 30 | A1 | 60 | — | — | — | — |
| Y-6 | 27 | WV6 | 231 | C1 | 30 | A1 | 60 | — | — | — | — |
| Y-7 | 27 | WV7 | 231 | C1 | 30 | A1 | 60 | — | — | — | — |
| Y-8 | 27 | WV1 | 291 | C1 | 30 | — | — | — | — | — | — |
| Y-9 | 27 | — | — | C1 | 30 | A1 | 238 | V1 | 30 | W1 | 23 |
| Y-10 | 28 | WV1 | 231 | — | — | A1 | 90 | — | — | — | — |
| Y-11 | 27 | — | — | C1 | 30 | A1 | 268 | — | — | W1 | 23 |
| Y-12 | 21 | WV8 | 231 | C1 | 30 | A1 | 60 | — | — | — | — |
| Y-13 | 32 | WV9 | 231 | C1 | 30 | A1 | 60 | — | — | — | — |

vinyl polymer (v1) was used in place of the aqueous dispersion liquid (A1) of an amorphous polyester resin (a1). The added amounts (in solid fraction) of these compounds are described in Table 3.

<<Preparation Method of Yellow Toner (Y-11)>>

A yellow toner (Y-11) was obtained in the same manner as preparation of the yellow toner (Y-9) as described in Table 3 except that the aqueous dispersion liquid (V1) of an amorphous vinyl polymer (v1) was not used.

<<Preparation Method of Magenta Toners (M-2) to (M-7), (M-9), and (M-11)>>

Magenta toners (M-2) to (M-7), (M-9), and (M-11) were obtained in the same manner as preparation of the magenta toner (M-1) except the following change. The kind and the amount of an aqueous dispersion liquid of an amorphous vinyl polymer containing a releasing agent, the amount of the aqueous dispersion liquid (C1) of a crystalline polyester resin (c1), and the amount of the aqueous dispersion liquid (A1) of an amorphous polyester resin (a1) were changed as described in Table 4. In addition, the aqueous dispersion liquid of an amorphous vinyl polymer containing a releasing agent in Table 4 was prepared in the same manner as described in the above-described portion of "<Preparation of aqueous dispersion liquid (WV1) of amorphous vinyl polymer containing releasing agent (wv1)>" except the following change. The kind of an acrylate used in the second step polymerization, and the monomer mixture used in the third step polymerization were changed as described in Table 1.

TABLE 4

| | | Aqueous dispersion liquid of amorphous vinyl polymer containing releasing agent | | Aqueous dispersion liquid of crystalline polyester resin | | Aqueous Dispersion liquid of amorphous polyester resin | | Aqueous Dispersion liquid of amorphous vinyl polymer | | Aqueous dispersion liquid of releasing agent | |
|---|---|---|---|---|---|---|---|---|---|---|---|
| Magenta toner | Toner acid value (mg KOH/g) | No. | Added amount (Mass parts: in solid fraction) | No. | Added amount (Mass parts: in solid fraction) | No. | Added amount (Mass parts: in solid fraction) | No. | Added amount (Mass parts: in solid fraction) | No. | Added amount (Mass parts: in solid fraction) |
| M-1 | 29 | WV10 | 231 | C1 | 30 | A1 | 60 | — | — | — | — |
| M-2 | 31 | WV3 | 231 | C1 | 30 | A1 | 60 | — | — | — | — |
| M-3 | 29 | WV11 | 231 | C1 | 30 | A1 | 60 | — | — | — | — |
| M-4 | 29 | WV12 | 231 | C1 | 30 | A1 | 60 | — | — | — | — |
| M-5 | 29 | WV13 | 231 | C1 | 30 | A1 | 60 | — | — | — | — |
| M-6 | 29 | WV14 | 231 | C1 | 30 | A1 | 60 | — | — | — | — |
| M-7 | 29 | WV10 | 291 | C1 | 30 | — | — | — | — | — | — |
| M-8 | 29 | — | — | C1 | 30 | A2 | 238 | V1 | 30 | W1 | 23 |
| M-9 | 30 | WV10 | 231 | — | — | A1 | 90 | — | — | — | — |
| M-10 | 29 | — | — | C1 | 30 | A2 | 268 | — | — | W1 | 23 |
| M-11 | 32 | WV9 | 231 | C1 | 30 | A1 | 60 | — | — | — | — |

<<Preparation Method of Magenta Toner (M-8)>>

A magenta toner (M-8) was obtained in the same manner as preparation of the yellow toner (Y-9) except the following change. The coloring agent C.I. Pigment Red 122 was used in place of C.I. Pigment Yellow 74, and an aqueous dispersion liquid (A2) of an amorphous polyester (a2) was used in place of the aqueous dispersion liquid (A1) of an amorphous polyester (a1). The acid value of the aqueous dispersion liquid (A2) was adjusted by suitably changing the monomer ratio.

<<Preparation Method of Magenta Toner (M-10)>>

A magenta toner (M-10) was obtained in the same manner as preparation of the magenta toner (M-8) as described in Table 4 except that the aqueous dispersion liquid (V1) of an amorphous vinyl polymer (v1) was not used.

<<Preparation Method of Cyan Toners (C-2) to (C-7), (C-9), and (C-11)>>

Cyan toners (C-2) to (C-7), (C-9), and (C-11) were obtained in the same manner as preparation of the cyan toner (C-1) except the following change. The kind and the amount of an aqueous dispersion liquid of an amorphous vinyl polymer containing a releasing agent, the amount of the aqueous dispersion liquid (C1) of a crystalline polyester resin (c1), and the amount of the aqueous dispersion liquid (A1) of an amorphous polyester resin (a1) were changed as described in Table 5. In addition, the aqueous dispersion liquid of an amorphous vinyl polymer containing a releasing agent in Table 5 was prepared in the same manner as described in the above-described portion of "<Preparation of aqueous dispersion liquid (WV1) of amorphous vinyl polymer containing releasing agent (wv1)>" except the following change. The kind of an acrylate used in the second step polymerization, and the monomer mixture used in the third step polymerization were changed as described in Table 1.

TABLE 5

| | | Aqueous dispersion liquid of amorphous vinyl polymer containing releasing agent | | Aqueous dispersion liquid of crystalline polyester resin | | Aqueous dispersion liquid of amorphous polyester resin | | Aqueous dispersion liquid of amorphous vinyl polymer | | Aqueous dispersion liquid of releasing agent | |
|---|---|---|---|---|---|---|---|---|---|---|---|
| Cyan toner | Toner acid value (mg KOH/g) | No. | Added amount (Mass parts: in solid fraction) | No. | Added amount (Mass parts: in solid fraction) | No. | Added amount (Mass parts: in solid fraction) | No. | Added amount (Mass parts: in solid fraction) | No. | Added amount (Mass parts: in solid fraction) |
| C-1 | 32 | WV9 | 231 | C1 | 30 | A1 | 60 | — | — | — | — |
| C-2 | 34 | WV15 | 231 | C1 | 30 | A1 | 60 | — | — | — | — |
| C-3 | 32 | WV16 | 231 | C1 | 30 | A1 | 60 | — | — | — | — |

TABLE 5-continued

| Cyan toner | Toner acid value (mg KOH/g) | Aqueous dispersion liquid of amorphous vinyl polymer containing releasing agent No. | Added amount (Mass parts: in solid fraction) | Aqueous dispersion liquid of crystalline polyester resin No. | Added amount (Mass parts: in solid fraction) | Aqueous dispersion liquid of amorphous polyester resin No. | Added amount (Mass parts: in solid fraction) | Aqueous dispersion liquid of amorphous vinyl polymer No. | Added amount (Mass parts: in solid fraction) | Aqueous dispersion liquid of releasing agent No. | Added amount (Mass parts: in solid fraction) |
|---|---|---|---|---|---|---|---|---|---|---|---|
| C-4 | 32 | WV17 | 231 | C1 | 30 | A1 | 60 | — | — | — | — |
| C-5 | 32 | WV18 | 231 | C1 | 30 | A1 | 60 | — | — | — | — |
| C-6 | 32 | WV19 | 231 | C1 | 30 | A1 | 60 | — | — | — | — |
| C-7 | 32 | WV9 | 291 | C1 | 30 | — | — | — | — | — | — |
| C-8 | 32 | — | — | C1 | 30 | A3 | 238 | V1 | 30 | W1 | 23 |
| C-9 | 33 | WV9 | 231 | — | — | A1 | 90 | — | — | — | — |
| C-10 | 32 | — | — | C1 | 30 | A3 | 268 | — | — | W1 | 23 |
| C-11 | 37 | WV20 | 231 | C1 | 30 | A1 | 60 | — | — | — | — |

<<Preparation Method of Cyan Toner (C-8)>>

A cyan toner (M-8) was obtained in the same manner as preparation of the yellow toner (Y-9) except the following change. The coloring agent C.I. Pigment Blue 18:3 was used in place of C.I. Pigment Yellow 74, and an aqueous dispersion liquid (A3) of an amorphous polyester (a3) was used in place of the aqueous dispersion liquid (A1) of an amorphous polyester (a1). The acid value of the aqueous dispersion liquid (A3) was adjusted by suitably changing the monomer ratio.

<<Preparation Method of Cyan Toner (C-10)>>

A cyan toner (C-10) was obtained in the same manner as preparation of the cyan toner (C-8) as described in Table 5 except that the aqueous dispersion liquid (V1) of an amorphous vinyl polymer was not used.

<<Preparation Method of Black Toners (Bk-2) to (Bk-6), and (Bk-8)>>

Black toners (Bk-2) to (Bk-6), and (Bk-8) were obtained in the same manner as preparation of the black toner (Bk-1) except the following change. The kind and the amount of an aqueous dispersion liquid of an amorphous vinyl polymer containing a releasing agent, the amount of the aqueous dispersion liquid (C1) of a crystalline polyester resin (c1), and the amount of the aqueous dispersion liquid (A1) of an amorphous polyester resin (a1) were changed as described in Table 6. In addition, the aqueous dispersion liquid of an amorphous vinyl polymer containing a releasing agent in Table 6 was prepared in the same manner as described in the above-described portion of "<Preparation of aqueous dispersion liquid (WV1) of amorphous vinyl polymer containing releasing agent (wv1)>" except the following change. The kind of an acrylate used in the second step polymerization, and the monomer mixture used in the third step polymerization were changed as described in Table 1.

TABLE 6

| Black toner | Toner acid value (mg KOH/g) | Aqueous dispersion liquid of amorphous vinyl polymer containing releasing agent No. | Added amount (Mass parts: in solid fraction) | Aqueous dispersion liquid of crystalline polyester resin No. | Added amount (Mass parts: in solid fraction) | Aqueous dispersion liquid of amorphous polyester resin No. | Added amount (Mass parts: in solid fraction) | Aqueous dispersion liquid o amorphous vinyl polymer No. | Added amount (Mass parts: in solid fraction) | Aqueous dispersion liquid of releasing agent No. | Added amount (Mass parts: in solid fraction) |
|---|---|---|---|---|---|---|---|---|---|---|---|
| Bk-1 | 32 | WV9 | 231 | C1 | 30 | A1 | 60 | — | — | — | — |
| Bk-2 | 32 | WV16 | 231 | C1 | 30 | A1 | 60 | — | — | — | — |
| Bk-3 | 32 | WV17 | 231 | C1 | 30 | A1 | 60 | — | — | — | — |
| Bk-4 | 32 | WV18 | 231 | C1 | 30 | A1 | 60 | — | — | — | — |
| Bk-5 | 32 | WV19 | 231 | C1 | 30 | A1 | 60 | — | — | — | — |
| Bk-6 | 32 | WV9 | 291 | C1 | 30 | — | — | — | — | — | — |
| Bk-7 | 32 | — | — | C1 | 30 | A3 | 238 | V1 | 30 | W1 | 23 |
| Bk-8 | 33 | WV9 | 231 | — | — | A1 | 90 | — | — | — | — |
| Bk-9 | 32 | — | — | C1 | 30 | A3 | 268 | — | — | W1 | 23 |

<<Preparation Method of Black Toner (Bk-7)>>

A black toner (Bk-7) was obtained in the same manner as preparation of the yellow toner (Y-9) except the following change. The coloring agent of carbon black was used in place of C. I. Pigment Yellow 74, and an aqueous dispersion liquid (A3) of an amorphous polyester (a3) was used in place of the aqueous dispersion liquid (A1) of an amorphous polyester (a1). The acid value of the aqueous dispersion liquid (A3) was adjusted by suitably changing the monomer ratio.

<<Preparation Method of Black Toner (Bk-9)>>

A black toner (Bk-9) was obtained in the same manner as preparation of the black toner (Bk-7) as described in Table 6 except that the aqueous dispersion liquid (V1) of an amorphous vinyl polymer (v1) was not used.

[Acid Value Difference]

(Acid Value)

An acid value is an amount of potassium hydroxide in mg required to neutralize the carboxy group existing in 1 g of sample. The acid value is measured based on the method described in JIS K0070-1992.

(1) Preparation of Reagents (a) Phenolphthalein Solution 1.0 g of phenolphthalein was dissolved in 90 mL of ethyl alcohol (95 vol %), then ion-exchanged water was added to make a volume of 100 mL. Thus, a phenolphthalein solution was obtained.

(b) Potassium Hydroxide Solution 7.0 g of potassium hydroxide (special grade) was dissolved in 5 mL of ion-exchanged water. Then, ethyl alcohol (95 vol %) was added to make a volume of 1 L. The solution was placed in an alkali resistive container to avoid contact with carbon dioxide. After leaving it for 3 days, the solution was filtered to obtain a potassium hydroxide solution. The obtained potassium hydroxide solution was stored in an alkali resistive container.

(c) Factor of Potassium Hydroxide Solution

A factor of a potassium hydroxide solution was determined as follows. Into a conical flask was placed 25 mL of 0.1 ml/L hydrochloric acid. Several drops of phenolphthalein solution were added to the conical flask. Then, titration was conducted with the above-described potassium hydroxide solution. The factor was determined from the amount of the potassium hydroxide solution needed to neutralize the hydrochloric acid solution.

(d) Hydrochloric Acid Solution

The above-described 0.1 ml/L hydrochloric acid was prepared based on the description of JIS K8001-1998.

(2) Operation (a) Main Test 2.0 g of toner was accurately weighted and placed in a 200 mL conical flask. Then, 100 mL of mixed solvent of toluene and ethanol (2:1) was added in the conical flask, and the toner was dissolved over a period of 5 hours.

Subsequently, several drops of the phenolphthalein solution were added as an indicator. The solution of the toner was titrated with the potassium hydroxide solution. The end point of the titration was made at the point that the pale red color of the indicator was remained for about 30 seconds.

(b) Blank Test

The same titration as described above was done without using a toner sample (namely, only the mixed solvent of toluene an ethanol (2:1) was used for titration).

(3) An Acid Value was Calculated by Substituting the Obtained Results in the Following Relation.

$$A=[(C-D)\times f\times 5.611]/S$$

The characters in the relation mean the following.

A: Acid value (mg KOH/g)

C: Added amount (mL) of potassium hydroxide solution in the main test.

D: Added amount (mL) of potassium hydroxide solution in the blank test.

f: Factor of 0.1 mol/L potassium hydroxide ethanol solution 5.611: Molar mass of potassium hydroxide 56.11 (g/mol)×(1/10)

S: Mass (g) of sample.

The acid value difference was calculated from the acid value of each color toner in the toner set obtained as described above.

[Evaluation Method]

The above-described toner sets 1 to 13 were subjected to the following evaluation tests. The evaluation results are listed in Table 7. In Table 7, "Acid value of each color toner: Y/M/C/K" indicates the acid value (mg KOH/g) of Yellow toner/Magenta toner/Cyan toner/Black toner.

<Low-Temperature Fixability>

In a multi-function printer "bizhub PRO™ C6501" (made by Konica Minolta, Inc.), the fixing device was modified in such a manner that the surface temperature of the heat roller for fixing was adjustable in the range of 100 to 210° C. The developers made of the above-described toners were respectively charged to the printer. As a paper for evaluation, an A4 sized plain paper (basis weight: 80 g/m$^2$) was used. A fixing test was repeatedly conducted to fix a solid image having an amount of adhered toner of 11 mg/10 cm$^2$ by gradually increasing the fixing temperature from 85° C. to 130° C. with a step of 5° C.

Subsequently, each of the printed matters obtained in the fixing test at different temperatures was folded by a folding machine so that a load is applied to the solid image, and air compressed at a pressure of 0.35 MPa was blown to the formed crease. The condition of the crease was ranked into 5 grades as described in the following evaluation criteria. Among the fixing test results acquired Rank 3, the lowest fixing temperature in the fixing tests was taken as the lowest fixing temperature. And it was evaluated according to the following criteria.

(Criteria of Ranks at Crease)

Rank 5: No peel-off is observed at the crease.

Rank 4: A partial peel-off is found along the crease.

Rank 3: A narrow linear peel-off is found along the crease.

Rank 2: A bold linear peel-off is found along the crease.

Rank 1: A large peel-off is found in the image.

(Evaluation Criteria for Fixing Temperature)

A: The lowest fixing temperature is not more than 105° C.

B: The lowest fixing temperature is larger than 105° C. and not more than 118° C.

C: The lowest fixing temperature is larger than 118° C. and not more than 120° C.

D: The lowest fixing temperature is larger than 120° C.

The lower the lowest fixing temperature, the better the Low-temperature fixability. When the lowest fixing temperature is not more than 120° C., it will not cause any practical problem. The evaluation classes of A, B and C are in the category of passing an examination.

<Thermal Resistance>

0.5 g of toner was placed in a 10 mL glass bottle having an inner diameter of 21 mm, and the bottle was closed with a lid. Then, the glass bottle was shook 600 times by use of a shaker "Tapdenser KYT-2000" (manufactured by Seishin Enterprise Co. Ltd.), and the glass bottle was left still for two hours on the lid-opened condition under the environment of a temperature of 55° C. and a humidity of 35% RH. Thereafter, the toner was taken out from the glass bottle, and placed on a screen mesh with 48 meshes (mesh size: 350 μm) with care such that aggregation substance of toner was not crushed. The screen mesh was set on "powder tester" (manufactured by Hosokawa Micron Co.), and fixed with a pressing bar and a knob nut, thereafter, applied with vibration for 10 seconds with a vibration strength to cause a feeding width of 1 mm. After the application of vibration, the amount of the toner remained on the screen mesh was measure, and the toner aggregation rate was calculated by the following relation.

Toner aggregation rate (mass %)=(Amount (g) of toner remained on the screen mesh/0.5 (g))×100

This evaluation test was repeatedly conducted with increasing the temperature by a step of 0.1° C. until the case of obtaining the toner aggregation rate of 50 mass %. The maximum test temperature that does not exceed the toner aggregation rate of 50 mass % (it is called as a limit heat-resistant storage temperature) is an indicator of the thermal resistance.

(Evaluation Criteria)

A: The limit heat-resistant storage temperature is 60° C. or more.

B: The limit heat-resistant storage temperature is from 57° C. or more to less than 60° C.

C: The limit heat-resistant storage temperature is from 56° C. or more to less than 57° C.

D: The limit heat-resistant storage temperature is less than 56° C.

The cases in which the limit heat-resistant storage temperature is 56° C. or more are in the category of passing an examination (A, B, and C).

<Document Offset Property (Image Stability)>

A multi-function printer "bizhub PRO™ C6501" (made by Konica Minolta, Inc.) provided with its exclusive finisher "FS-608" (made by Konica Minolta, Inc.) was used as an image forming apparatus, and the automatic product preparation test for 100 sets of inner-bound prints (one set: 5 sheets) was conducted repeatedly 50 times. In this automatic product preparation test, a pixel rate per one page was set to 50% and a paper sheet with a weight of 64 g/m$^2$ was used as an image recording sheet (transfer sheet). The produced inner-bound prints were cooled to a room temperature with natural cooling, and all pages of the inner-bound prints were visually checked, and a page having the largest degree of image defect in the visual image was evaluated based on the following criteria. In this evaluation, Rank 3 and Rank 4 are acceptable levels.

(Evaluation Criteria)

Rank 1:

On the image portions, image defects, such as white omission, take place, and even on the non-image portions, clear image transfer takes place. Accordingly, the document offset resistance is very poor.

Rank 2: Disorder is caused in paper sheet alignment so that a front edge is cut out on the condition that images are inclined on some pages, or image defects and image transfer are caused as problems in practical use, for example, trace of image adhesion takes place as uneven brightness at some places on image portions. Accordingly, the document offset resistance is poor.

Rank 3: When pages in which image portions are superimposed to each other are turned up, some clear sounds are generated. However, in image portions and non-image portions, there are not image defects and image transfer that cause problems in practical use. Accordingly, the document offset resistance is good.

Rank 4: In both image portions and non-image portions, there are not image defects and image transfer at all. Accordingly, the document offset resistance is very good.

<Color Gamut>

The obtained solid fixed image patch was evaluated. The L*a*b* values of 2002 kinds of color patches were measured with a spectrometer "Gretag Macbeth Spectrolino" (made by Gretag Macbeth Co. Ltd.). The color gamut volume rate in the combination of the solid fixed image patch of Examples and Comparative examples was calculated, and it was represented by making the color gamut volume rate of Japan Color to be 100%.

(Evaluation Criteria)

A: Color gamut volume rate is 110% or more.

B: Color gamut volume rate is 105% or more to less than 110%.

C: Color gamut volume rate is less than 105%.

The cases in which the color gamut volume rate is 105% or more are in the category of passing an examination (A and B). Thus, the color reproducibility was evaluated.

<Environmental Difference of Charge Amount>

19 g of carrier and 1 g of toner were placed in a 20 mL glass container. For humidity control, the samples were left for 12 hours under the conditions of the low-temperature with low-humidity environment (10° C., 20% RH) and under the conditions of the high-temperature with high-humidity environment (30° C., 80% RH), respectively. Then, the glass containers were shaken for 20 minutes in the respective conditions with a rotation rate of 200 times/minutes, shaking angle of 45 degree, and an arm length 50 cm. A charge amount was measured with a measuring apparatus as illustrated in FIG. 1.

In FIG. 1, the numbers represent the following: 36 and 37 are a parallel flat electrode; 38 is a variable capacitor; 39 and 40 are an electric source; 42 is a personal computer; 43 and 44 are a resistor; 45 is a buffer; 46 is a two-component developer; and 47 is an A/D converter.

The measurement was done by the following configuration. 50 mg of two-component developer 46 was located by sliding through the parallel flat (aluminum) electrodes 36 and 37. The toner was developed under the conditions of: an interelectrode gap of 0.5 mm; a DC bias of 1.0 kV; an AC bias of 4.0 kV with 2.0 kHz. The electric charge and the mass of toner supplied on the developing region were measured. The amount of electric charge per unit mass Q/m (μC/g) was determined, and this value was taken as "a charge amount".

(Evaluation Criteria)

The evaluation was done as ranked below based on the difference between the charge amount under the low-temperature with low-humidity environment and the charge amount under the high-temperature with high-humidity environment.

A: Less than 10 μC/g (Very good)

B: 10 μC/g or more to less than 15 μC/g (Good)

C: 15 μC/g or more to less than 20 μC/g (Practicable)

D: 20 μC/g or more (Impracticable)

The cases that have the difference of less than 20 μC/g are in the category of passing an examination (A, B, and C).

TABLE 7

| | | Acid value of each color toner | | Content of crystalline | Content of amorphous vinyl | Alkyl group ($R^2$) in alkyl (meth)acrylate | | | Properties | | | |
|---|---|---|---|---|---|---|---|---|---|---|---|---|
| | Toner set No. | Y/M/C/K (mgKOH/g) | *1 | resin (mass %) | polymer (mass %) | Number of carbon atoms | Structure (Branched or Straight) | *2 | Thermal resistance | Document offset property | Color gamut | *3 |
| Example 1 | 1 | 27/29/32/32 | 5 | 10 | 70 | 8 | Branched | B | B | Rank4 | A | A |
| Example 2 | 2 | 24/29/34/32 | 10 | 10 | 70 | 8 | Branched | B | B | Rank4 | B | C |
| Example 3 | 3 | 31/31/32/32 | 1 | 10 | 70 | 8 | Branched | B | B | Rank4 | B | A |

TABLE 7-continued

| | Toner set No. | Acid value of each color toner Y/M/C/K (mgKOH/g) | *1 | Content of crystalline resin (mass %) | Content of amorphous vinyl polymer (mass %) | Alkyl group ($R^2$) in alkyl (meth)acrylate Number of carbon atoms | Structure (Branched or Straight) | *2 | Properties Thermal resistance | Document offset property | Color gamut | *3 |
|---|---|---|---|---|---|---|---|---|---|---|---|---|
| Example 4 | 4 | 27/29/32/32 | 5 | 10 | 70 | 8 | Straight | C | B | Rank4 | A | A |
| Example 5 | 5 | 27/29/32/32 | 5 | 10 | 70 | 22 | Branched | B | C | Rank4 | A | A |
| Example 6 | 6 | 27/29/32/32 | 5 | 10 | 70 | 26 | Branched | B | C | Rank3 | A | A |
| Example 7 | 7 | 27/29/32/32 | 5 | 10 | 70 | 4 | Straight | C | C | Rank4 | A | A |
| Example 8 | 8 | 27/29/32/32 | 5 | 10 | 90 | 8 | Branched | C | C | Rank4 | A | A |
| Example 9 | 9 | 27/29/32/32 | 5 | 10 | 10 | 8 | Branched | A | B | Rank3 | A | A |
| Comparative example 1 | 10 | 28/30/33/33 | 5 | None | 70 | 8 | Branched | D | A | Rank4 | A | A |
| Comparative example 2 | 11 | 27/29/32/32 | 5 | 10 | None | 8 | Branched | A | C | Rank2 | A | B |
| Comparative example 3 | 12 | 21/29/37/32 | 16 | 10 | 70 | 8 | Branched | B | B | Rank4 | C | D |
| Comparative example 4 | 13 | 32/32/32/32 | 0 | 10 | 70 | 8 | Branched | B | B | Rank4 | C | A |

*1: Acid value difference (mg KOH/g)
*2: Low-temperature fixability
*3: Environmental charge stability

CONCLUSION

The evaluation results in Table 7 demonstrate the following. By setting an acid value difference between color toners, especially between yellow toner, magenta toner, cyan toner and black toner, the present invention enabled to provide a full color toner set for developing an electrostatic image excellent in low-temperature fixability and thermal resistance, and also excellent in document offset property, color gamut, and environmental charge stability.

What is claimed is:

1. A method of forming an electrophotographic image using a plurality of color toners, the method comprising: a charging step; an exposing step; a developing step; and a transferring step, wherein the plurality of color toners each respectively contain toner particles including a binder resin, a coloring agent, a releasing agent, and a crystalline resin;

the binder resin comprises an amorphous vinyl polymer formed with vinyl monomers, and the vinyl monomers comprise a vinyl monomer having a carboxy group in a range of 2 to 7 mass %;

the toner particles contain the amorphous vinyl polymer in the range of 10 to 90 mass %; and a maximum value of an acid value difference of the color toners is in the range of 1 to 10 mg KOH/g.

2. The method of forming an electrophotographic image described in claim 1, wherein the amorphous vinyl polymer is a styrene-acrylic resin; and the styrene-acrylic resin contains a structural unit derived from an alkyl (meth)acrylate monomer represented by Formula (1), $$H_2C{=}CR^1{-}COOR^2 \qquad \text{Formula (1):}$$

wherein $R^1$ represents a hydrogen atom or a methyl group; and $R^2$ represents an alkyl group of 6 to 22 carbon atoms.

3. The method of forming an electrophotographic image described in claim 2, wherein $R^2$ in Formula (1) represents a branched alkyl group of 6 to 22 carbon atoms.

4. The method of forming an electrophotographic image described in claim 1, wherein the toner particles in the plurality of color toners contain the amorphous vinyl polymer in the range of 50 to 80 mass %.

5. The method of forming an electrophotographic image described in claim 1, wherein the crystalline resin is a crystalline polyester resin.

6. The method of forming an electrophotographic image described in claim 5, wherein the crystalline polyester resin is a hybrid resin having an amorphous resin segment bonded with a chemical bond.

7. The method of forming an electrophotographic image described in claim 1, wherein the plurality of color toners each are a yellow toner, a magenta toner, a cyan toner, and a black toner.

8. The method of forming an electrophotographic image described in claim 1, wherein the maximum value of an acid value difference of the color toners is in the range of 2 to 6 mg KOH/g.

9. The method of forming an electrophotographic image described in claim 1, wherein the crystalline resin contained in the toner particles is in the range of 1 to 30 mass %.

10. A full color toner set for developing an electrostatic image, the full color toner set comprising a plurality of color toners, wherein the plurality of color toners each respectively contain toner particles including a binder resin, a coloring agent, a releasing agent, and a crystalline resin;

the binder resin comprises an amorphous vinyl polymer formed with vinyl monomers, and the vinyl monomers comprise a vinyl monomer having a carboxy group in a range of 2 to 7 mass %;

the toner particles contain the amorphous vinyl polymer in the range of 10 to 90 mass %; and a maximum value of an acid value difference of the color toners is in the range of 1 to 10 mg KOH/g.

11. The full color toner set described in claim 10, wherein the amorphous vinyl polymer is a styrene-acrylic resin; and the styrene-acrylic resin contains a structural unit derived from an alkyl (meth)acrylate monomer represented by Formula (1), $$H_2C{=}CR^1{-}COOR^2 \qquad \text{Formula (1);}$$

wherein $R^1$ represents a hydrogen atom or a methyl group; and $R^2$ represents an alkyl group of 6 to 22 carbon atoms.

12. The full color toner set described in claim 11, wherein $R^2$ in Formula (1) represents a branched alkyl group of 6 to 22 carbon atoms.

13. The full color toner set described in claim 10, wherein the toner particles in the plurality of color toners contain the amorphous vinyl polymer in the range of 50 to 80 mass %.

14. The full color toner set described in claim 10, wherein the crystalline resin is a crystalline polyester resin.

15. The full color toner set described in claim 14, wherein the crystalline polyester resin is a hybrid resin having an amorphous resin segment bonded with a chemical bond.

16. The full color toner set described in claim 10, wherein the plurality of color toners each are a yellow toner, a magenta toner, a cyan toner, and a black toner.

17. The full color toner set described in claim 10, wherein the maximum value of an acid value difference of the color toners is in the range of 2 to 6 mg KOH/g.

18. The full color toner set described in claim 10, wherein the crystalline resin contained in the toner particles is in the range of 1 to 30 mass %.

19. The full color toner set described in claim 10, wherein each of the color toners has an acid value in the range of 21 to 37 mg KOH/g.

20. The full color toner set described in claim 10, wherein at least two toners of the toner set have different amounts of the vinyl monomer having the carboxy group.

* * * * *